US011019853B2

(12) United States Patent
Drynan et al.

(10) Patent No.: US 11,019,853 B2
(45) Date of Patent: Jun. 1, 2021

(54) BACKLESS SUPPORT BRA

(71) Applicant: SEXY BACK BRA, LLC, Whitefish, MT (US)

(72) Inventors: Skye Drynan, Whitefish, MT (US); Gordana Gehlhausen, Playa del Rey, CA (US)

(73) Assignee: SEXY BACK BRA, LLC., Whitefish, MT (US)

( * ) Notice: Subject to any disclaimer, the term of this patent is extended or adjusted under 35 U.S.C. 154(b) by 481 days.

(21) Appl. No.: 15/669,413

(22) Filed: Aug. 4, 2017

(65) Prior Publication Data

US 2017/0347720 A1 Dec. 7, 2017

Related U.S. Application Data

(63) Continuation-in-part of application No. 14/809,073, filed on Jul. 24, 2015, now Pat. No. 9,750,288, and a (Continued)

(51) Int. Cl.
*A41C 3/00* (2006.01)
*A41B 9/08* (2006.01)
(Continued)

(52) U.S. Cl.
CPC ..... *A41C 3/0078* (2013.01); *A41B 9/002* (2013.01); *A41B 9/08* (2013.01); *A41C 3/0028* (2013.01); *A41C 1/06* (2013.01)

(58) Field of Classification Search
CPC ..... A41B 9/08; A41B 9/002; A41C 3/0078; A41C 1/006; A41C 1/08; A41C 1/06;
(Continued)

(56) References Cited

U.S. PATENT DOCUMENTS 172,694 A * 1/1876 Blakeslee ..... A41C 1/06 450/8
298,067 A 5/1884 Clarke
(Continued)

FOREIGN PATENT DOCUMENTS

CH 179421 A 9/1935
CH 239201 A 9/1945
(Continued)

OTHER PUBLICATIONS

Barbara Stepko, The Big Reveal: Looks That Show Off Your Back, Jul. 21, 2016, The Wall Street Journal (10 pgs) https://www.wsj.com/articles/the-big-reveal-looks-that-show-off-your-back-1469127690.
(Continued)

*Primary Examiner* — Alissa J Tompkins
*Assistant Examiner* — Brieanna Szafran
(74) *Attorney, Agent, or Firm* — Cowan, Liebowitz & Latman, P.C.; Mark Montague

(57) ABSTRACT

A backless support bra for supporting a wearer's breasts utilizing cups and various straps particularly configured to provide an unobstructed view of the wearer's back, thus enabling the wearer to wear backless type garments over the inventive backless support bra. Some of the described versions of the backless support bra further support the wearer's breasts in a manner that provides an unobstructed view of the wearer's center chest area, thus enabling the wearer the wear a garment that has a low cut or plunging neckline.

8 Claims, 38 Drawing Sheets

Related U.S. Application Data continuation-in-part of application No. 29/573,642, filed on Aug. 8, 2016, now Pat. No. Des. 793,653, and a continuation-in-part of application No. 29/573,643, filed on Aug. 8, 2016, now Pat. No. Des. 793,654, and a continuation-in-part of application No. 29/573,644, filed on Aug. 8, 2016, now Pat. No. Des. 793,655, and a continuation-in-part of application No. 29/573,645, filed on Aug. 8, 2016, now Pat. No. Des. 793,656.

(60) Provisional application No. 62/372,282, filed on Aug. 8, 2016.

(51) Int. Cl.
*A41B 9/00* (2006.01)
*A41C 1/06* (2006.01)

(58) Field of Classification Search
CPC .. A41C 1/02; A41C 1/003; A41C 1/04; A41C 1/10; A41F 1/006; A41F 18/00; A41F 19/00; A61F 5/03; A61F 13/14; A61F 13/143; A61F 13/145; A61F 13/146; A61F 13/148
USPC ..... D2/701, 708, 709
See application file for complete search history.

(56) References Cited

U.S. PATENT DOCUMENTS

| | | | | |
|---|---|---|---|---|
| 463,050 | A | | 11/1891 | Harvey |
| 561,427 | A | | 6/1896 | McKay |
| 751,641 | A | | 2/1904 | Hazelbaker |
| 839,699 | A | | 12/1906 | Anderson |
| 862,170 | A | | 8/1907 | Kellogg |
| 880,444 | A | | 2/1908 | Donaldson |
| 959,441 | A | | 5/1910 | Anderson |
| 1,033,788 | A | | 7/1912 | Dennis |
| 1,060,329 | A | | 4/1913 | Feldman |
| 1,067,289 | A | | 7/1913 | Volk |
| 1,205,758 | A | | 11/1916 | Leeman |
| 1,434,231 | A | | 10/1922 | Sherry |
| 1,522,658 | A | | 1/1925 | Voorhees |
| 1,562,128 | A | | 11/1925 | Stanley |
| 1,649,736 | A | | 11/1927 | Rosenthal |
| 1,762,399 | A | | 6/1930 | Kops |
| 1,797,022 | A | | 3/1931 | Reinohl |
| 1,831,607 | A | | 11/1931 | Reese |
| 1,840,937 | A | | 1/1932 | Duff |
| 1,955,523 | A | | 4/1934 | Yerkes |
| 1,962,984 | A | | 6/1934 | Crego |
| 2,057,224 | A | | 10/1936 | Barley |
| 2,118,406 | A | | 5/1938 | Klin |
| 2,126,591 | A | | 8/1938 | Voss |
| 2,127,927 | A | | 8/1938 | McCabe |
| 2,248,204 | A | | 7/1941 | Snider |
| 2,315,930 | A | | 4/1943 | Burke |
| 2,351,680 | A | | 6/1944 | Hatton |
| 2,352,367 | A | | 6/1944 | Bujdossy |
| 2,397,710 | A | | 4/1946 | Versoy et al. |
| D151,742 | S | | 11/1948 | Dache |
| 2,475,893 | A | | 7/1949 | Hayes |
| 2,490,351 | A | | 12/1949 | Gradara |
| 2,542,881 | A | | 2/1951 | Ries |
| 2,585,257 | A | * | 2/1952 | Lee ..... A41C 3/00 450/68 |
| 2,712,821 | A | * | 7/1955 | De Wolf ..... A61F 5/0093 128/98.1 |
| 2,719,568 | A | | 10/1955 | Webb |
| 2,779,943 | A | | 2/1957 | Kelleher |
| 2,895,480 | A | | 7/1959 | Fixel |
| 2,918,920 | A | | 12/1959 | Lutsky |
| 3,077,885 | A | | 2/1963 | Hopper |
| 3,109,431 | A | | 11/1963 | Jefferson |
| 3,216,425 | A | | 11/1965 | Keersmaecker |
| 3,306,299 | A | | 2/1967 | Paramore |
| 3,411,508 | A | | 11/1968 | Sayers |
| 3,465,754 | A | | 9/1969 | Lockwood et al. |
| 3,939,845 | A | | 2/1976 | Guidoni |
| 3,982,547 | A | | 9/1976 | Walker |
| D249,096 | S | | 8/1978 | Fowler |
| 4,191,192 | A | | 3/1980 | McDavid |
| 4,418,696 | A | | 12/1983 | Delet |
| 4,475,552 | A | * | 10/1984 | Yoshihara ..... A41C 1/06 450/107 |
| 4,656,669 | A | | 4/1987 | Beard |
| 4,815,145 | A | | 3/1989 | Chow |
| D300,880 | S | | 5/1989 | Mathis |
| 4,983,140 | A | | 1/1991 | Gimble |
| 5,120,264 | A | | 6/1992 | Van Engel |
| 5,162,015 | A | | 11/1992 | Otani |
| 5,884,340 | A | | 3/1999 | Chen et al. |
| 6,009,556 | A | | 1/2000 | Nenninger |
| D433,786 | S | | 11/2000 | Gladstone |
| 6,173,449 | B1 | | 1/2001 | Osterrath |
| D453,604 | S | | 2/2002 | Hart |
| 6,397,391 | B2 | | 6/2002 | DeMarco |
| 6,547,636 | B1 | | 4/2003 | Cato |
| D492,089 | S | | 6/2004 | Flannery |
| 6,817,038 | B2 | | 11/2004 | Blanco |
| D562,528 | S | | 2/2008 | Deal |
| D579,177 | S | | 10/2008 | Paul |
| D587,878 | S | | 3/2009 | Higo et al. |
| 7,572,167 | B2 | | 8/2009 | Cheng |
| 7,607,964 | B2 | | 10/2009 | Mone et al. |
| D604,476 | S | | 11/2009 | Allen et al. |
| D625,487 | S | | 10/2010 | Hendrickson |
| D625,488 | S | | 10/2010 | Messman et al. |
| D626,308 | S | | 11/2010 | DiGeronimo |
| D629,587 | S | | 12/2010 | Tena |
| D709,670 | S | | 7/2014 | Vericella |
| D731,745 | S | | 6/2015 | Maragni |
| D733,994 | S | | 7/2015 | Hays et al. |
| D734,591 | S | | 7/2015 | Jirsa |
| D741,566 | S | | 10/2015 | Perry et al. |
| D748,371 | S | | 2/2016 | Oliver |
| D756,066 | S | | 5/2016 | Lorie |
| D762,944 | S | | 8/2016 | Gehlhausen |
| D763,545 | S | | 8/2016 | Morin |
| 2003/0187323 | A1 | | 10/2003 | Goodman |
| 2005/0064790 | A1 | | 3/2005 | Mone et al. |
| 2006/0039165 | A1 | | 2/2006 | Harris et al. |
| 2007/0236916 | A1 | | 10/2007 | Hsu |
| 2010/0192285 | A1 | | 8/2010 | Ahn |
| 2012/0156962 | A1 | | 6/2012 | Krawchuk |
| 2013/0183885 | A1 | | 7/2013 | Yamazaki et al. |
| 2016/0338419 | A1 | | 11/2016 | Fayad |

FOREIGN PATENT DOCUMENTS

| | | | |
|---|---|---|---|
| DE | 333705 | A | 3/1921 |
| FR | 378041 | A | 9/1907 |
| FR | 765468 | A | 6/1934 |
| GB | 182032 | A | 6/1922 |
| GB | 311217 | A | 5/1929 |
| GB | 323650 | A | 1/1930 |
| GB | 428783 | A | 5/1935 |
| JP | 57-005406 | A | 1/1982 |
| JP | 57-005407 | A | 1/1982 |
| JP | 10-226904 | A | 8/1998 |
| JP | 2001-020104 | A | 1/2001 |
| KR | 30-0876844-0000 | | 10/2016 |
| RU | 145718 | U1 | 9/2014 |
| TW | D184157 | | 7/2017 |

OTHER PUBLICATIONS

Simply Fab: Maidenform Breakthrough Backless Bra posted at popsugar.com earliest date available Apr. 9, 2008, [online], acquired on Mar. 14, 2016. Available from Internet, <URL: http://www.popsugar.com/fashion/Simply-Fab-Maidenform-Breakthrough-Backless-Bra-1506218>.

(56) References Cited

OTHER PUBLICATIONS

The above reference was cited in the International Search Report of the corresponding International Application, PCT/US2017/045574 dated Nov. 2, 2017.
Foreign references 1-3 were cited in Japanese Office Action dated May 26, 2020 in corresponding Japanese Application No. 2019-505232, English translation is enclosed.
Foreign reference 4 was cited in the Russian Notice of Allowance dated Aug. 19, 2020 in the corresponding Russian Application No. 2019102698.

* cited by examiner

BACKLESS SUPPORT BRA

REFERENCE TO RELATED APPLICATIONS

This application is a continuation-in-part of U.S. patent application Ser. No. 14/809,073, filed Jul. 24, 2015, U.S. Design patent application Ser. No. 29/573,642, filed Aug. 8, 2016, U.S. Design patent application Ser. No. 29/573,643, filed Aug. 8, 2016, U.S. Design patent application Ser. No. 29/573,644, filed Aug. 8, 2016, and U.S. Design patent application Ser. No. 29/573,645, filed Aug. 8, 2016, and claims priority under 35 U.S.C. 119(e) to U.S. Provisional Patent Application No. 62/372,282, filed Aug. 8, 2016, and the disclosures of each and every one of these applications are incorporated herein by reference.

BACKGROUND OF THE INVENTION

1. Field of the Invention

The present invention relates generally to undergarments, more particularly, to bras affording bust support and an unobstructed view of the wearer's back.

2. Description of the Related Art

Traditional women's undergarments, namely bras, such as shown in FIG. 36, generally have a front main portion with two cups, wings extending from the front portion surrounding the wearer's ribcage, a hook and eye closure to connect the two wings, and two shoulder straps. Traditional bras are practical for everyday use under daily wear, such as t-shirts, blouses, sweaters, etc. However, these traditional bras are not suitable for all purposes. For example, traditional bras are unsuitable to be worn with backless garments, such as formal gowns.

One trendy or fashionable design that has been and remains popular among many women are articles of clothing that reveal their backs, such as low-cut or backless clothing. For example, evening gowns, prom dresses, cocktail dresses, and the like that are low-cut in the back or backless are considered to be elegant by many men and women. The low-cut and backless look is also permeating into other types of clothing such as the backless halter-top, which is considered among some of the trendy fashion items.

One way in which the basic bra design has evolved is to eliminate the need for shoulder straps, such as shown in FIG. 37. Thus, the entire support for the wearer's breasts must be achieved through both the cup design and the back straps. This type of bra is commonly referred to as the strapless bra, which can be worn with clothing that exposes the wearer's shoulders. However, the back straps of the strapless bra are still exposed if worn with low-cut or backless clothing.

Another solution has been a strapless and backless bra as disclosed in U.S. Pat. No. 6,397,391. There are no wings of the bra to be exposed under a backless garment. However, this configuration provides little support to the breasts, resulting in an undesirable appearance. Indeed, where a strap descends on the wearer's arm or neck, the bottom of the bra cup may become displaced from the wearer's torso, with the result that the base of the breast may even slip below the cup.

Various other non-ideal solutions are currently available, including silicone cups with adhesives, a strapless bustier bra with a plunging back and boning along the sides. The silicone cups with adhesive option allows for any type of backless garment to be worn. However, these cups, only supported by adhesives or adhesive wings, do not provide sufficient support or lift for those wearers having larger breasts. Silicone cups that are held with an adhesive, such as glue, are generally believed to be inferior since the strength of the adhesive deteriorates over time and particularly when the wearer perspires. Moreover, clothing and other products that adhere to a person's skin generally are not desired since their removal is painful, causes irritation to the wearer's skin, or both. These problems with garments, including undergarments, that adhere to a wearer's skin are thus generally not purchased or otherwise used, independent of the shape of the wearer's body or the wearer's cup size.

Bustier bras with a plunging back, such as shown in FIG. 38, often cause an undesirable and unsightly bulging effect in the back area, an area in which many wearers carry excess skin and fat. Because these bustier bras are strapless, they need to be secured very tightly around the torso to provide support and remain securely in place. But because they must b e secured tightly, the bulging effect is exacerbated.

Accordingly, there is a desire and long felt need for a bra that can be suitably worn with low-cut or backless articles of clothing and that provides support for the wearer's breasts in the same or similar way as a traditional or basic bra. The present invention is directed to such a bra.

OBJECTS AND SUMMARY OF THE INVENTION in view of the foregoing, it is an object of the present invention to provide a backless support bra that overcomes one, some or all the problems associated with the prior art, such as briefly discussed above.

It is a further object of the present invention to provide a backless support bra that provides an unobstructed view of the wearer's back, while providing sufficient support to the wearer's breasts. It is another object of the present invention to provide a backless support bra that can be suitably work with open back or backless dresses, and other types of garments for which it is desirable to see the wearer's back unobstructed by straps and other components of the bra.

It is yet a further object of the present invention to provide a backless support bra that is easy to wear, easy to adjust, and that is designed to be appropriately positioned on the wearer.

It is yet another object of the present invention to provide versions of a backless support bra that enable the wearer to wear a garment with a low or very low/plunging neck line.

It is yet an additional object of the present invention to provide an undergarment that is easy to put on and take off, and that provides the wearer with one or more of the benefits described herein.

To achieve one or more of the foregoing and other objects, the present invention, in accordance with certain embodiments of the invention, is a backless support bra, comprising first and second cups with each of the cups configured to support a respective breast of a wearer when the backless support bra is worn, at least one upper strap having first and second ends for upwardly supporting the first and second cups, and first and second lower straps, with each of the first and second lower straps having first and second ends for downwardly supporting the first and second cups, and the first lower strap is configured to extend through a pelvic region of the wearer and to extend around one leg of the wearer, and the second lower strap is configured to extend through the pelvic region of the wearer and to extend around the other leg of the wearer.

As an aspect of the invention, the first and second cups are not in direct attachment to one another.

As a particular aspect, the first end of the first lower strap is attached to the first cup and the second end of the first lower strap is attached to the second cup, and the first end of the second lower strap is attached to the second cup and the second end of the second lower strap is attached to the first cup.

As a further aspect, substantially all of the first and second lower straps are disposed along a front portion of the wearer when worn so that substantially all of the wearer's back is unobstructed by the first and second lower straps and the at least one upper strap.

As yet another aspect, the straps are permanently affixed to the cups.

As yet a further aspect, at least one of the straps is removably connected to one of the cups.

As yet an additional aspect, said at least one upper strap is comprised of first and second upper straps, the first upper strap including first and second ends both attached to the first cup, and the second upper strap including first and second ends both attached to the second cup.

As a feature of this aspect, each of the first and second upper straps is configured to be worn around a respective shoulder of the wearer of the backless support bra.

As a further aspect, said at least one upper strap is comprised of only one upper strap that includes a first end attached to the first cup and a second end attached to the second cup.

As a feature of this aspect, the upper strap is configured to be worn around a neck of the wearer of the backless support bra.

As other aspects of the present invention, the backless support bra further comprises a front panty panel affixed to and extending between first portions of the first and second lower straps in a vicinity of a front pelvic region of the wearer, and a rear panty panel affixed to and extending between second portions of the first and second lower straps in a vicinity of a buttocks region of the wearer, wherein the front panty panel is configured to cover at least a portion of the front pelvic region of the wearer when worn and the rear panty panel is configured to cover at least a portion of the buttocks region of the wearer when worn.

As a feature of this aspect, the front and rear panty panels are configured as a thong-type panty.

As a further feature, the front and rear panty panels are configured as a full coverage type panty wherein at least a substantial portion of the wearer's buttocks is covered when worn.

As yet another feature, the front and rear panty panels are permanently affixed to the first and second lower straps.

As yet a further feature, the front and rear panty panels are configured as a single component that is removably attached to the first and second lower straps.

As yet another aspect of the invention, the first end of the first lower strap is attached to the first cup, and the second end of the first lower strap is attached to a mid-portion of the first lower strap, and the first end of the second lower strap is attached to the second cup, and the second end of the second lower strap is attached to a mid-portion of the second lower strap.

In accordance with a particular embodiment of the present invention, a backless support bra comprises first and second cups that are not in direct attachment to one another, with each of the first and second cups configured to support a respective breast of a wearer when the backless support bra is worn, at least one upper strap having first and second ends configured to upwardly support the first and second cups when worn, and first and second lower straps configured to downwardly support the first and second cups when worn, the first and second lower straps configured to extend downward from respective ones of the first and second cups to a pelvic region of the wearer, extend through a buttocks of the wearer, and extend around respective legs of the wearer.

In accordance with an aspect of this particular embodiment, a first end of the first lower strap is attached to the first cup and a second end of the first lower strap is attached to the second cup, and a first end of the second lower strap is attached to the second cup and a second end of the second lower strap is attached to the first cup.

In accordance with another aspect of this particular embodiment, said at least one upper strap is comprised of first and second upper straps, the first upper strap including first and second ends both attached to the first cup and configured to be worn around a first shoulder of the wearer, the second upper strap including first and second ends both attached to the second cup and configured to be worn around a second shoulder of the wearer.

In accordance with a further aspect of this particular embodiment, said at least one upper strap is a neck halter with a first end attached to the first cup and a second end attached to the second cup, the neck halter configured to be worn around a neck of the wearer.

In accordance with yet other embodiments of the present invention, methods of securing a backless support bra having the features described herein to a wearer of the backless support bra are included.

These and other embodiments, aspects and features of the present invention are described in the following detailed description. Additional objects, advantages and features of the present invention will become readily apparent to those of ordinary skill in the art from the following detailed description of the invention.

BRIEF DESCRIPTION OF THE DRAWINGS

The following detailed description, given by way of example and not intended the present invention solely thereto, will best be appreciated in conjunction with the accompanying drawings, herein like reference numerals denote like elements and parts, in which:

FIGS. 1-7 are schematic illustrations of a backless support bra, shown worn on a wearer, in accordance with a first embodiment of the present invention, wherein FIG. 1 is a front perspective view, FIG. 2 is a front view, FIG. 3 is a rear view, FIG. 4 is a left-side view, FIG. 5 is a right-side view, FIG. 6 is a top view, and FIG. 7 is a bottom view;

FIGS. 10-14 are schematic illustrations of a backless support bra with thong panty in accordance with a third embodiment of the present invention, wherein FIG. 10 is a front perspective view, FIG. 11 is a front view, FIG. 12 is a rear view, FIG. 13 is a left-side view and FIG. 14 is a right-side view;

FIGS. 15-21 are schematic illustrations of a backless support bra with full-coverage panty in accordance with a fourth embodiment of the present invention, wherein, FIG. 15 is a front perspective view, FIG. 16 is a front view, FIG. 17 is a rear view, FIG. 18 is a left-side view, FIG. 19 is a right-side view, FIG. 20 is the view from the top of the wearer and FIG. 21 is the view from the bottom of the wearer;

FIGS. 22-28 are schematic illustrations of a backless support bra with split cups in accordance with a fifth embodiment of the present invention, wherein FIG. 22 is a front perspective view, FIG. 23 is a front view, FIG. 24 is a rear view, FIG. 25 is a left-side view, FIG. 26 is a right-side view, FIG. 27 is a top view, and FIG. 28 is a bottom view;

FIGS. 29-35 are schematic illustrations of a backless support bra with split cups and neck halter in accordance with a sixth embodiment of the present invention, wherein FIG. 29 is a front perspective view, FIG. 30 is a front view, FIG. 31 is a rear view, FIG. 32 is a left-side view, FIG. 33 is a right-side view, FIG. 34 is a top view, and FIG. 35 is a bottom view;

DETAILED DESCRIPTION OF INVENTION

Figure 1:
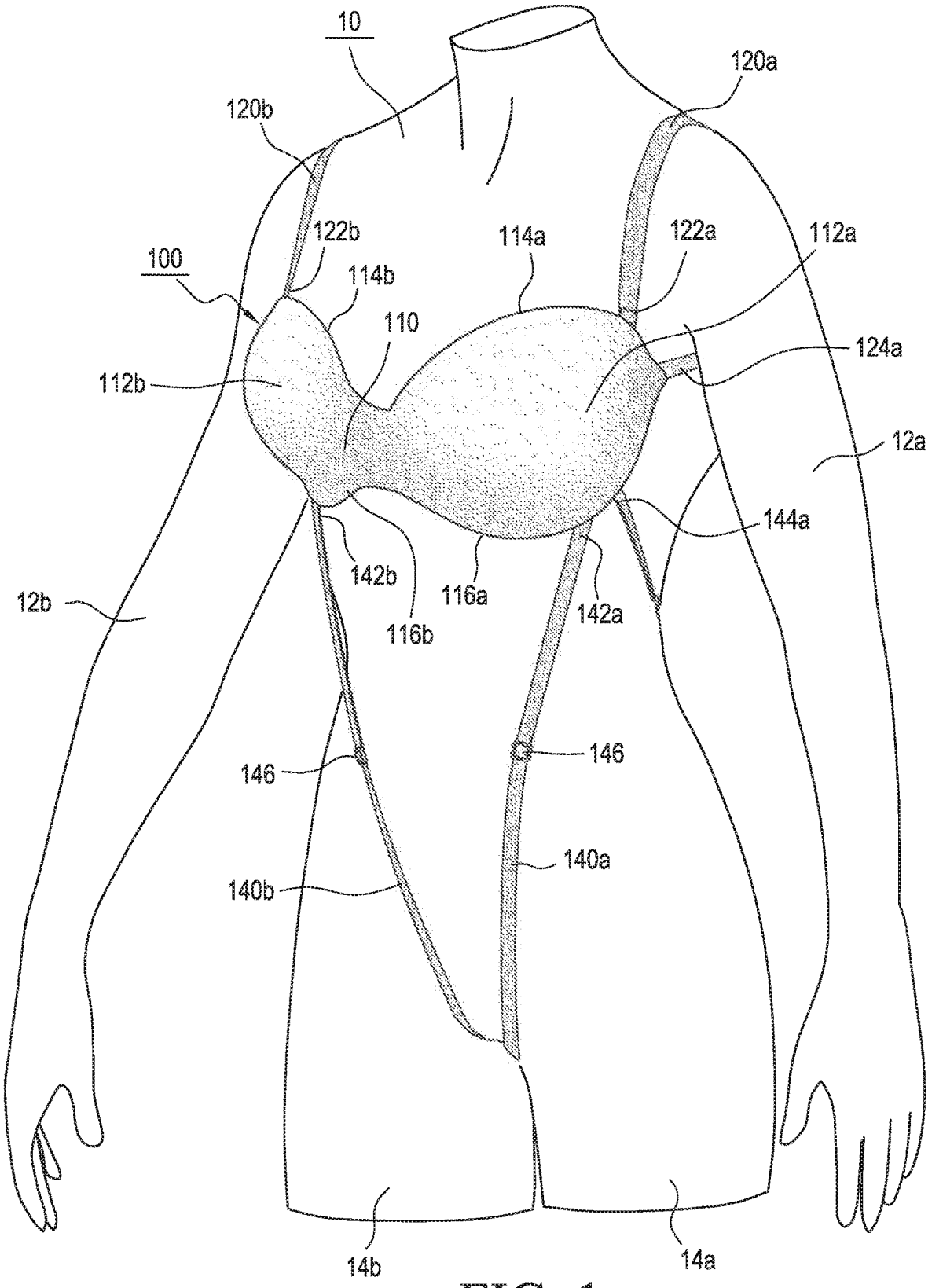

The following detailed description of the various embodiments of the present invention is made with reference to the accompanying drawings. In this detailed description, explanation about related functions or constructions known in the art are omitted for the sake of clearness in understanding the concept of the invention, and to avoid obscuring the invention with unnecessary detail. Moreover, it should be readily apparent from the discussion herein that there are many variations and modifications that will be apparent to those of ordinary skill in the art, and are intended to be within the scope of the inventive concepts herein disclosed.

In addition, certain terms are used throughout the discussion, such as "cup," "strap," "panel," etc., each of which is provided in order to provide a suitable frame of reference with regard to the inventive concepts herein and to aid the reader in understanding the present invention. These terms, however, are not intended to be over-limiting, except where so specifically indicated.

As discussed or otherwise appreciated from the discussion herein, the present invention in its various form is directed to a backless support bra that provides the wearer with an unobstructed view of the wearer's back and other benefits described herein. In certain embodiments, the bra further provides the wearer with an unobstructed view of the wearer's center chest area. With these embodiments of the present invention, a wearer of the inventive bra (in its various forms) is enabled to wear a garment that is backless without any portion of the bra being visible from the back. Hence, while wearing the inventive bra, which provides more than adequate support for the wearer's breasts, simultaneously allows for the wearing of so-called "backless" dresses and other backless type garments. Moreover, with certain embodiments described herein, the wearer of the bra also is able to wear a garment that has a low (or very low/plunging) neck line without any portion of the bra being visible from the front.

First Embodiment: Backless Support Bra

Referring now to the drawings, and particularly to FIGS. 1-7 thereof, a backless support bra 100 in accordance with a first embodiment of the present invention is disclosed. As shown in these figures, the backless support bra 100 (sometimes referred to herein, for convenience, bra 100) is shown worn by a wearer (i.e., a person) having a body 10, left and right arms 12*a* and 12*b*, left and right legs 14*a* and 14*b*, and a back 16 (back 16 shown best in the back view of FIG. 3).

Referring to FIG. 1 (and also shown in one or more of the various other FIGS. 2-7 of this embodiment), the backless support bra 100 includes a front main panel 110 and a set of straps. Front main panel 110 includes left and right cups 112*a* and 112*b*. Left cup 112*a*, when worn, supports the left breast of the wearer, and right cup 112*b* supports the right breast of the wearer. The left cup 112*a* has upper and lower edges 114*a* and 116*a*. Similarly, the right cup 112*b* has upper and lower edges 114*b* and 116*b*.

Figure 2:
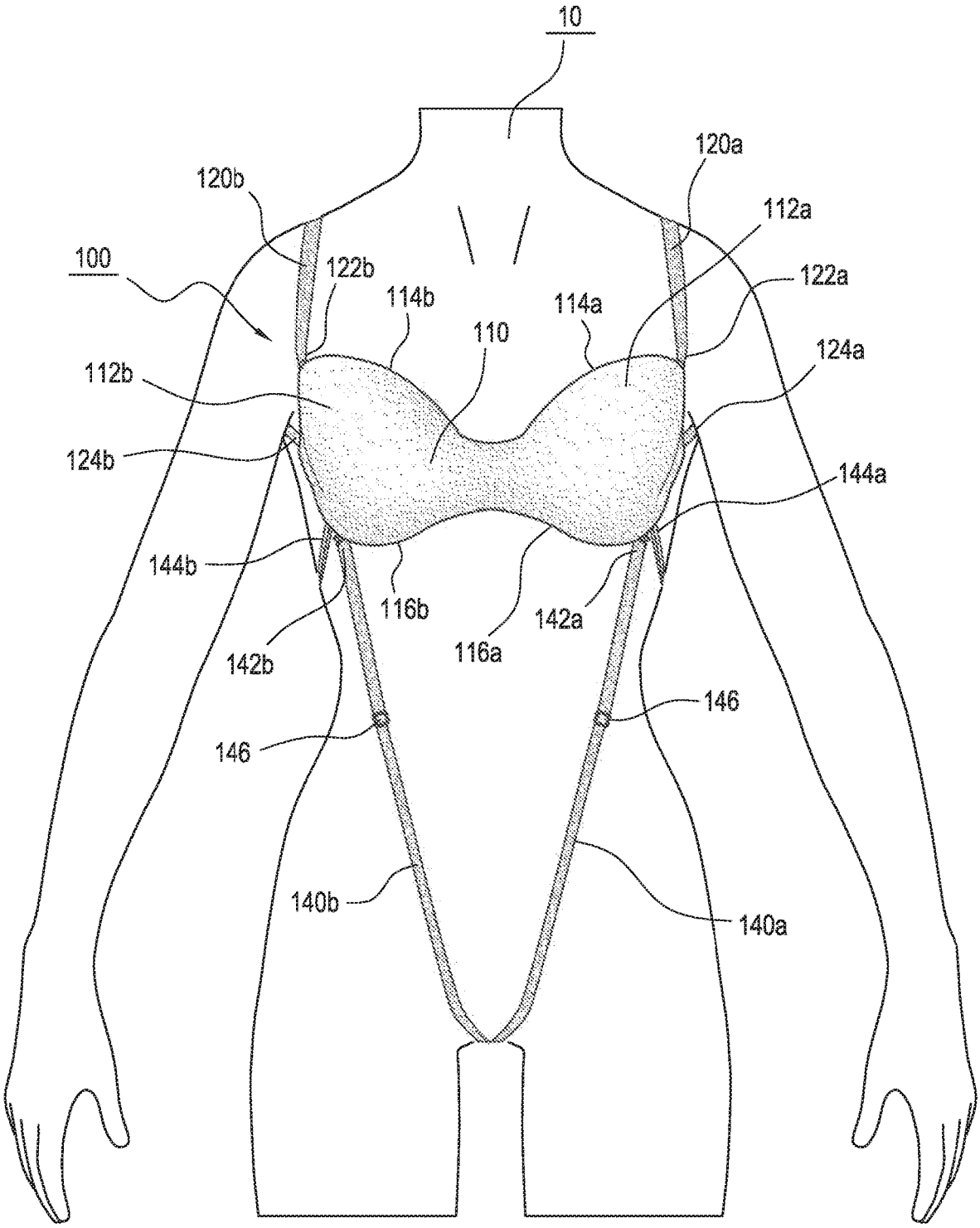

Referring to FIG. 2 (and also shown in other figures of this embodiment), backless support bra 100 includes a pair of upper shoulder straps and a pair of lower straps. Specifically, bra 100 includes left and right upper shoulder straps 120*a* and 120*b* (also referred to as "upper straps"). The lower straps are discussed further below. Each of the upper shoulder straps are attached to a respective one of the cups, and each strap is structured to go over a shoulder of the wearer when worn. Specifically, left cup 112*a* is supported on the body of the wearer by a left upper shoulder strap 120*a*, and the right cup 112*b* is supported on the body of the wearer the same way by a right upper shoulder strap 120*b*.

The left upper shoulder strap 120*a* has first and second ends 122*a* and 124*a*, and both ends are connected directly to the left cup 112*a* of the front main panel 110. This is best shown in FIG. 1, but also is visible in FIG. 2. Similarly, the right upper shoulder strap 120*b* has first and second ends 122*b* and 124*b*, and both ends are connected directly to the right cup 112*b* of the front main panel 110, as best shown in FIG. 2 (end 124 is hidden in FIG. 1).

Figure 4:
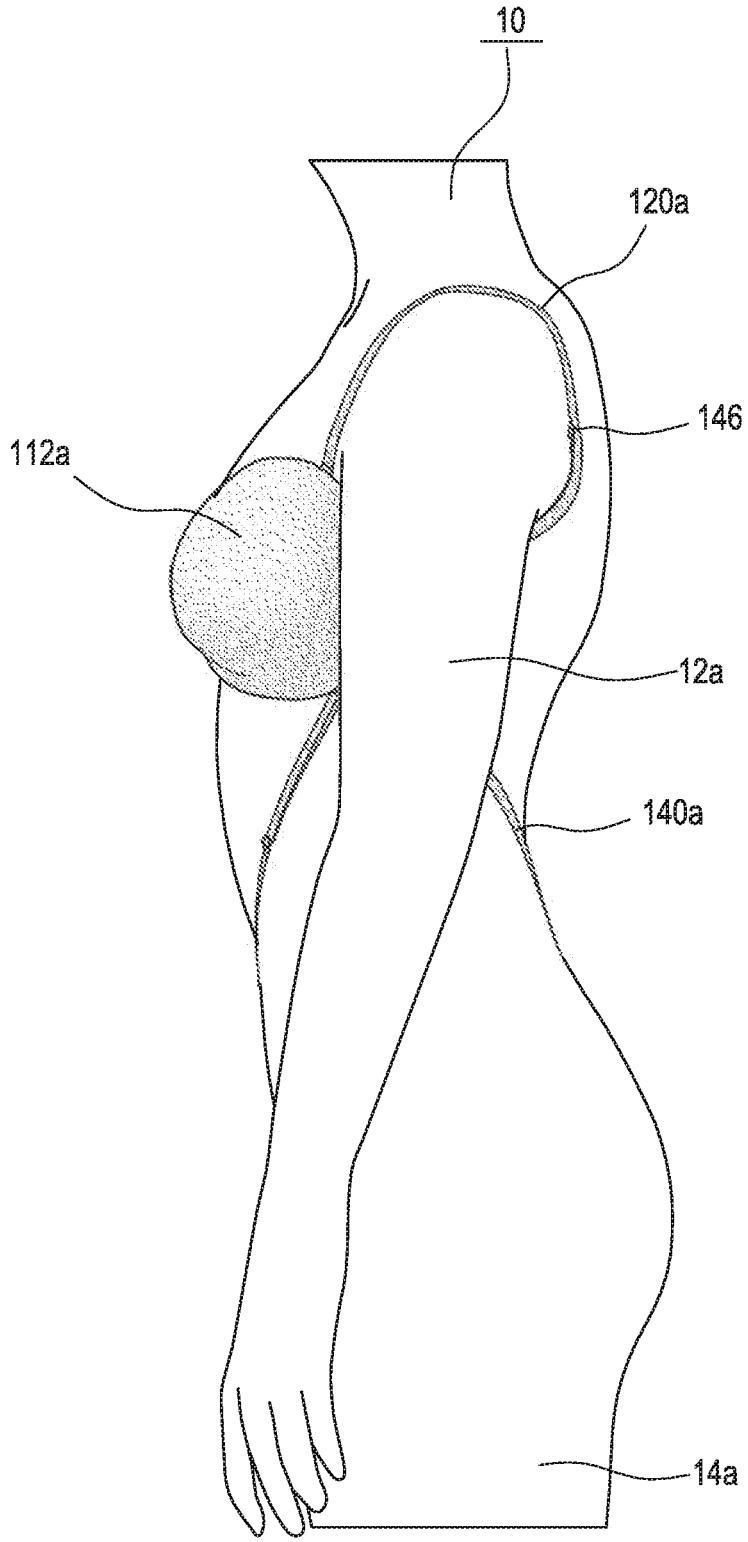

The left upper shoulder strap 120*a* forms a first shoulder loop, as shown in the side view of FIG. 4. Likewise, the right upper shoulder strap 120*b* forms a second shoulder loop, as shown in the other side view of FIG. 5.

Referring again to FIG. 1, the left upper shoulder strap 120*a* is attached to left cup 112*a* at its upper edge 114*a* (at end 122*a*), and also is attached to left cup 112*a* at a slightly lower point (at end 124*a*). This is also shown in FIG. 2. Similarly, and as shown in FIG. 2, the right upper shoulder strap 120*b* is attached to the upper edge 114*b* of the right cup 112*b* (at end 122*b*) and also is attached to the right cup 112*b* (at end 124*b*). In a variation of that described herein, the connection of the left and right upper straps to the left and right cups, respectively, may be made at different locations than that shown in the figures. In one version, the ends of each upper strap are connected at the same location of the respective cup. In another version, the ends of each upper strap are connected to a respective cup but further away from one another than that shown in the figures.

As mentioned above, the bra of this first embodiment of the present invention also includes a pair of lower straps. As described further herein, each of the lower straps includes two ends (i.e., first and second ends) and each end of each lower strap is connected to the lower edges of the cups of the bra's front main panel.

Figure 3:
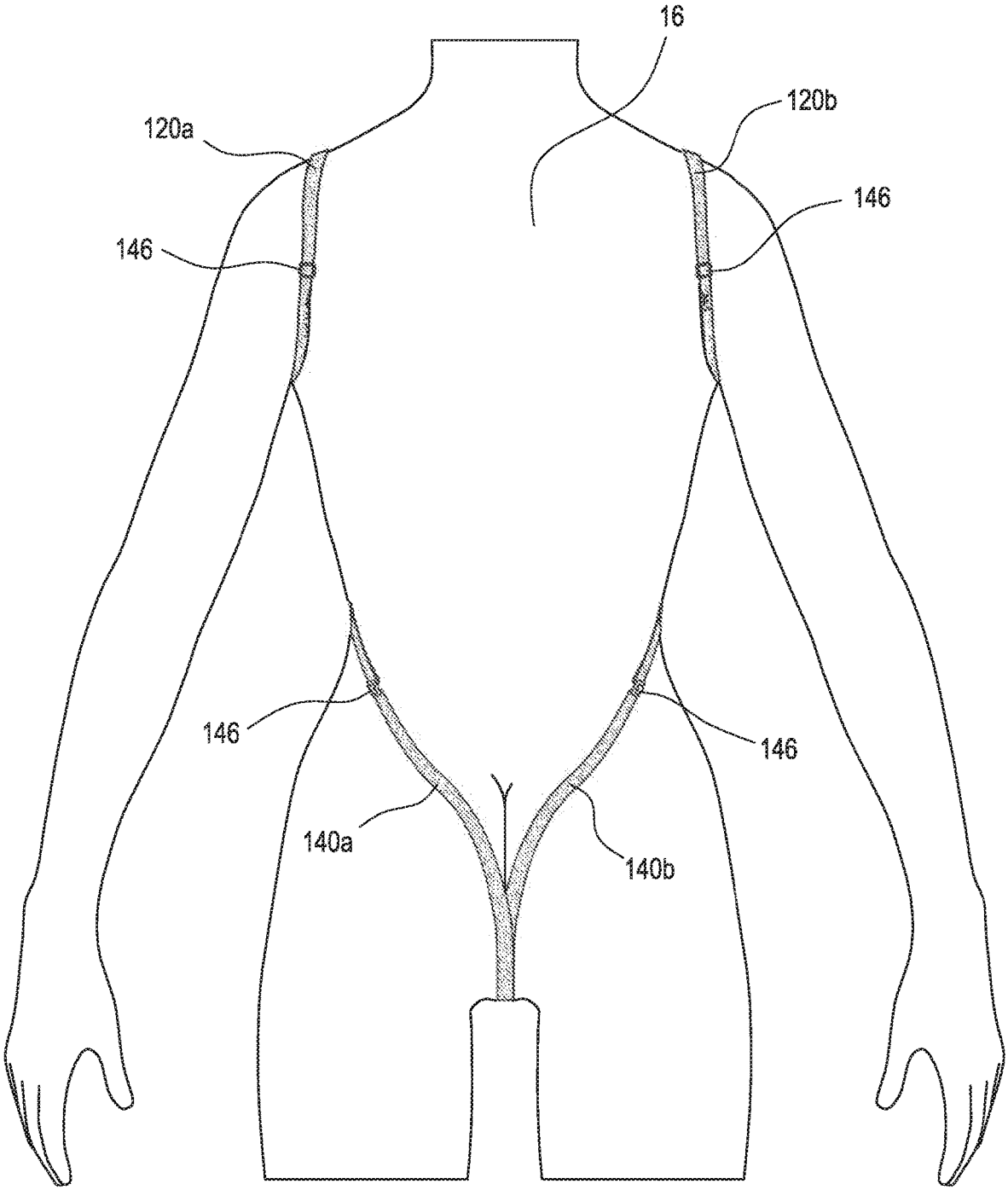
Figure 5:
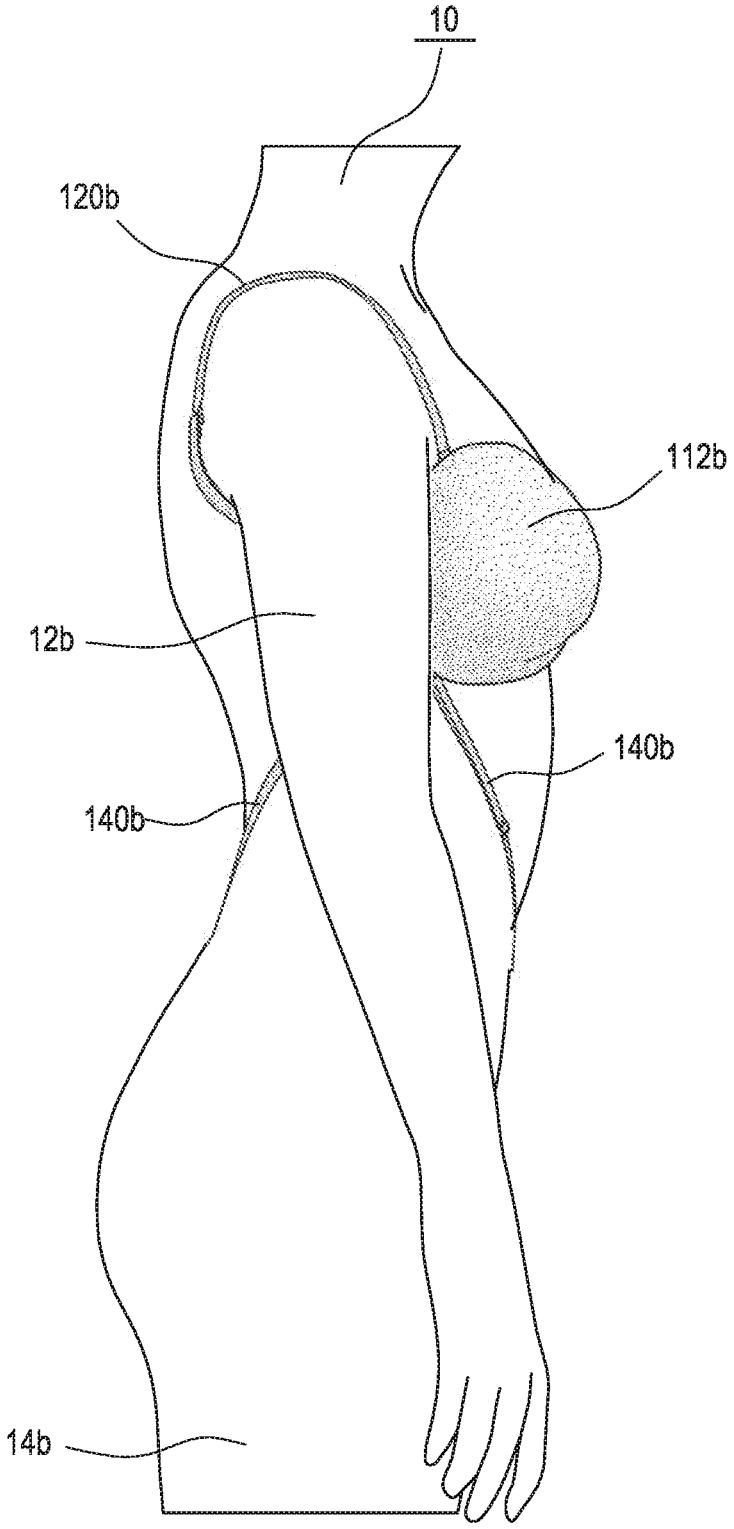
Figure 6:
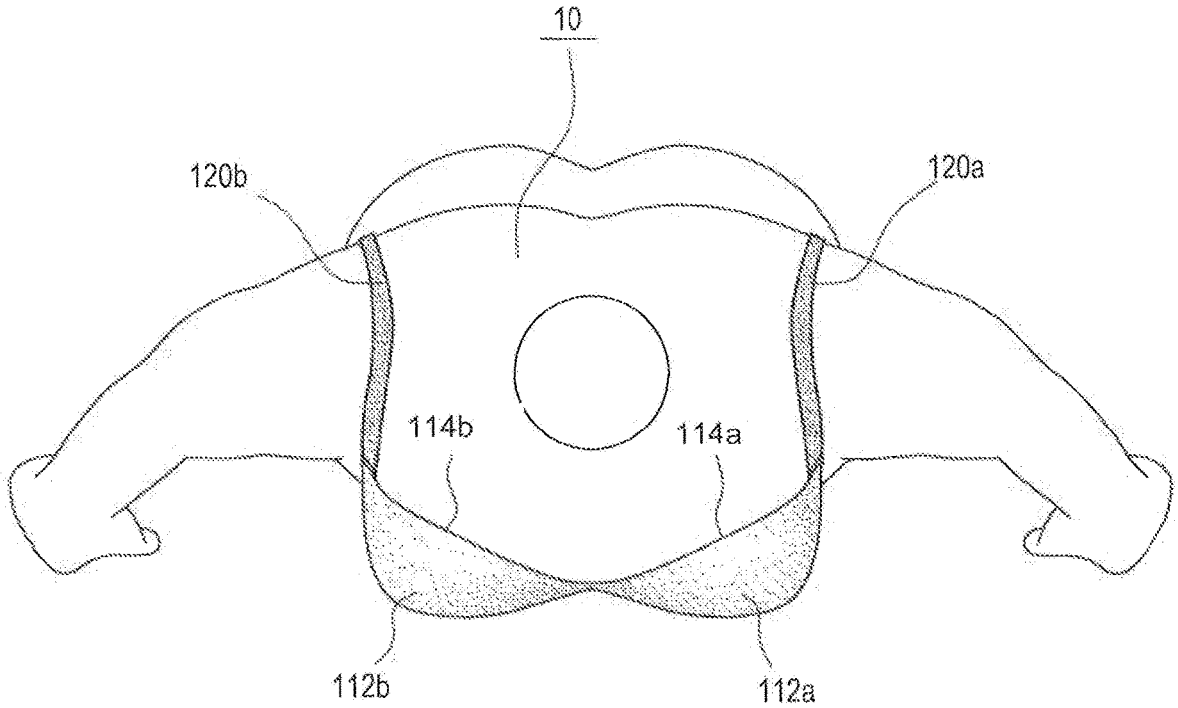
Figure 7:
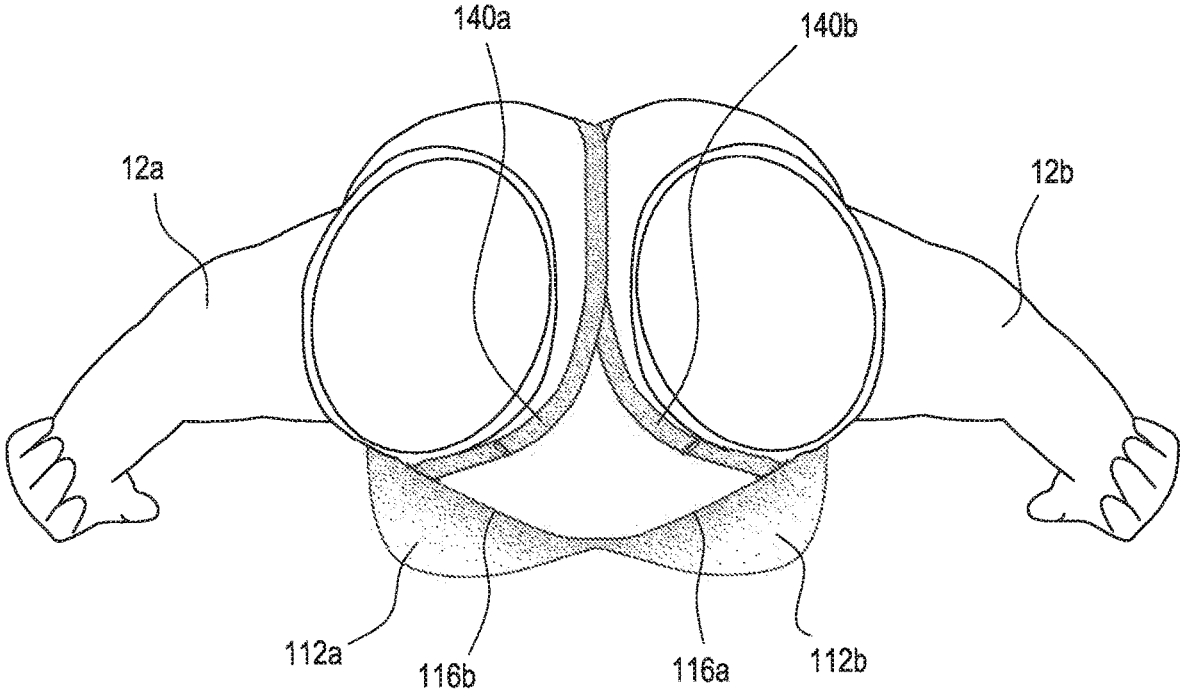

Each lower strap forms a "leg loop" wherein each strap (when worn by a user) extends down the front of the wearer's body (at the wearer's torso area), through the pelvic area of the wearer, then extends up the buttocks area of the wearer, and finally connecting to the bra's front main panel. With reference to the figures, each lower strap is shown to extend across the front of the wearer's torso as shown in FIG. 2, through the pelvic area as shown particularly in the bottom view of FIG. 7, back up around the buttocks area of the wearer as shown in FIG. 3, and then back to the bra's main panel as shown in FIGS. 4 and 5, as well as FIG. 1. It is noted that other figures also may show such positions.

As shown in FIG. 2, left lower strap 140*a* has first and second ends 142*a*, 144*a*. These ends are connected directly to (or near) the lower edge 116*a* of the left cup 112*a* of the bra. Likewise, right lower strap 140*b* has first and second ends 142*b*, 144*b*, and these ends are connected directly to (or near) the lower edge 116*b* the right cup 112*b* of the bra.

In one version of this first embodiment of the present invention, the upper shoulder straps 120*a*, 120*b* and the lower straps 140*a*, 140*b* are permanently affixed to the front main panel 110 of the bra 100. In another version, all of the straps are detachable from the bra's front main panel. The type of connection from the respective ends of the shoulder straps and lower straps to the front main panel can be any type of connection technique that is suitable for use on a bra.

In the versions in which the straps are permanently affixed to the main panel, such permanent affixing can be via sewing or stitching of the ends of the straps to the front main panel 110. Other manners of permanent affixing can also be employed. In such versions, the wearer "steps" into the leg loops formed by the lower straps 140*a*, 140*b* and then raises the upper shoulder straps 120*a*, 120*b* until they are disposed over the wearer's shoulders in order to put on the bra of the present invention.

With respect to versions of the present invention in which the straps are not permanently affixed to the main panel, one exemplary version is for each of the straps to be connectable to the bra's main panel via conventional hook and loop connectors. In such version, the upper shoulder straps 120*a*, 120*b* and lower straps 140*a*, 140*b* are detachably attached to the front main panel 110 at the loop portions disposed on the inside of front main panel 110. Loop portions are provided on the inside and along the edge of front main panel 110 to allow the hooks disposed on the first and second ends of the upper and lower straps to attach at various locations along the upper and lower edges of the two cups.

In yet other versions, one or some of the straps are permanently affixed to the bra's main panel, with one or more of the other straps being configured to be attachable and detachable (i.e., detachably affixable or detachably affixed) to/from the bra's main panel. In one such version, the bra of the present invention includes a pair of upper shoulder straps (as described herein) that are permanently affixed to the bra's main panel, and includes a pair of lower straps (as described herein) that are detachably affixed to the bra's main panel. In yet another version, the bra of the present invention includes a pair of upper shoulder straps (as described herein) that are detachably affixed to the bra's main panel, and includes a pair of lower straps (as described herein) that are permanently affixed to the bra's main panel.

As described and illustrated herein, when bra 100 of the present invention is worn by a wearer, the left lower strap 140*a* is configured to extend from the lower edge 116*a* of the left cup 112*a*, pass through the pelvic area of the wearer, to in-between the buttocks of the wearer, and then to reattach at the lower edge 116*a* of the left cup 112*a*. Similarly, the right lower strap 140*b* is configured to extend from the lower edge 116*b* of the right cup 112*b*, and pass through the pelvic area of the wear, to in-between the buttocks of the wearer, and then to reattach at the lower edge 116*b* of the right cup 112*b*.

The invention includes other configurations than that particularly shown in the figures. For instance, the first and second ends of each upper shoulder strap can be affixed at the same position or at different positions of each cup. For example, the first end of each upper shoulder strap is affixed at the upper edge of each cup, and the second end of each upper shoulder strap is affixed at a substantially lower or vertical edge of each cup.

Variations of the positions of the first and second ends to be affixed to the cups also may take into account the shape of the cups. Thus, each of the upper shoulder straps, in such versions, is configured to connect to a respective cup such that it appropriately positions the main front panel 110 over the wearer.

The figures show particular sizes and shapes of each of the straps of the inventive bra. However, the size and/or shape of each strap may be different than that shown. In one variation, the upper shoulder straps and the lower straps can be wider or narrower than that shown in the figures. Moreover, the straps may have different shapes, such as curved, wavy or other suitable shape. The straps also may be made of a variety of materials and a variety of colors, as would be appreciated by those in the art. The straps may be translucent or transparent, if desired.

In the various versions of the inventive bra described herein, any of the straps may be elastic and/or be adjustable in length via a suitable length adjustment mechanism. For instance, FIGS. 2 and 3 show sliders 146 to allow the wearer to suitably adjust the length of the straps. Such sliders are well known in the art and thus a discussion of their structure and method of use is omitted herein. Other suitable length adjustment mechanisms may be employed. Still further, bra 100 may include more or fewer (including none) length adjustment mechanisms on each of the bra's straps.

The left and right cups 112*a*, 112*b* of the bra 100 can be lined, padded, or otherwise enhanced to provide additional support and/or enhancement. The neckline created by the cups 112*a*, 112*b* of the front main panel 110 can be a variety of shapes as would be understood to those of ordinary skill in the art. Sizes of the cups can be, for example, from A-N, or other sizes, standard and non-standard.

The bra of the first embodiment (and select other embodiments) include left and rights cups that are of an integral one-piece construction, as in seamless molded bras. However, in variations, the bra may include separate cups that are joined together. Techniques for joining the cups include, for example, stitching or wherein each end of which is sewn to or integral with a respective cup. As another example, a clasp or other suitable connector, is included and used to attach and detach the cups. The cups shown in the figures of the first embodiment (and select other embodiments) are integral and thus permanently affixed together. However, in other variations, the cups are connectable and detachable from one another. In yet other variations, the cups are not connectable to one another and are designed to be worn in such unconnected state, such as with the fifth and sixth embodiments described herein (i.e., the two embodiments discussed with reference to FIGS. 22-35).

The neckline of the first embodiment described herein is shown to be contoured or molded, but the front main panel 110 and cups 112*a*, 112*b* of the bra 100 could be modified to provide any of the following styles: plunge, full-cup, demi-cup, push-up, balconette, and shelf, and other styles known in the art. The cups can be made from a variety of materials, and have different sizes and colors, as would be understood in the art.

The front main panel 110, in different variations, may include channels that have a structural support wire (commonly called an "underwire") accommodated in the lower edges 116*a*, 116*b* of the two cups to provide additional support and lift to the wearer's breasts. In particular, each bra cup may have underwire extending around the bottom (including the sides) of the cups. Typically, as is conventional in underwire bras, the underwire is disposed within the cup or wrapped in padding or cushioning material sewn onto the inner surface of the cup. In either case, the underwire is itself concealed and at least somewhat padded to minimize the discomfort otherwise caused thereby to the wearer.

The bra 100, in any of the variations described herein, may be made of natural material or synthetic material, and non-limiting examples include cotton, leather, satin, silk, nylon, spandex, polyester and other known materials, and any combination thereof.

Silicone inserts or silicone strips may be included (in any of the variations described herein) to an inside of the left and right cups in order to aid in allowing the bra to stick to the skin of the wearer and minimize slipping, and/or for other desired purposes.

Having described the backless support bra in accordance with a first embodiment of the present invention, along with multiple variations thereof, it is appreciated that the bra provides a substantially unobstructed view of the wearer's back. This, in turn, permits the backless support bra of the present invention to be worn with a backless, V-back, or peek-a-boo back dress, or other appropriate dress, as well as with another type of article of clothing wherein the inventive bra is not visible along any portion of the wearer's back, such as illustrated in the back view of FIG. 3. As shown in FIG. 3, the upper straps of the bra appear immediately adjacent to the upper portions of the wearer's arm and near the wearer's shoulders, but at positions relatively far away from the wearer's neck. Accordingly, the entire upper back of the wearer is unobstructed by the inventive bra in accordance with this embodiment (and all other embodiments described herein). As also shown in FIG. 3, the lower straps are disposed in the vicinity of the wearer's buttocks and, thus, the entire lower back of the wearer also is unobstructed by the inventive bra.

Second Embodiment: Backless Support Bra with Self-Reattaching Lower Straps

Figure 8:
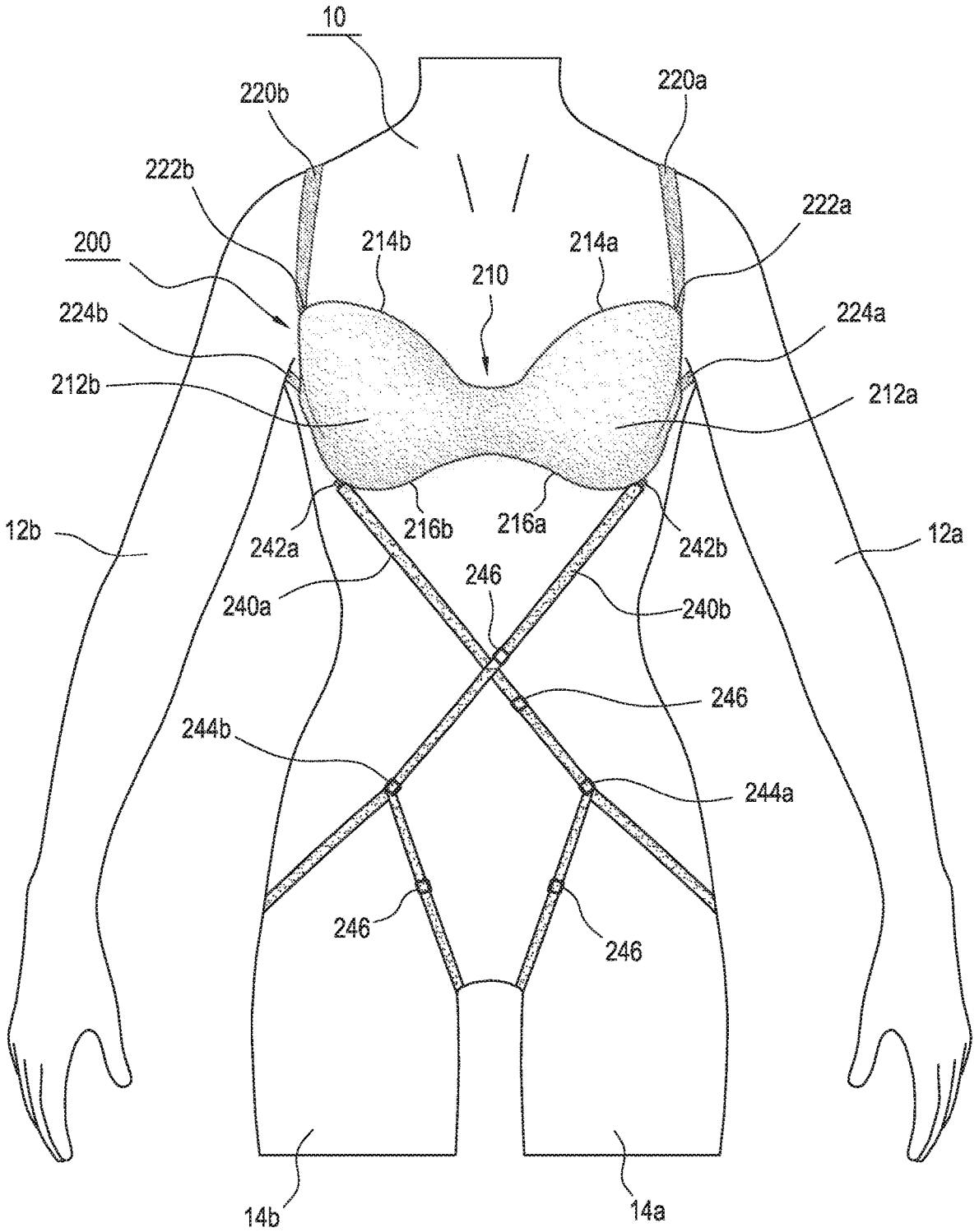
FIGS. 8 and 9 are schematic illustrations of a front view and rear view, respectively, of a backless support bra in accordance with a second embodiment of the present invention.
Figure 9:
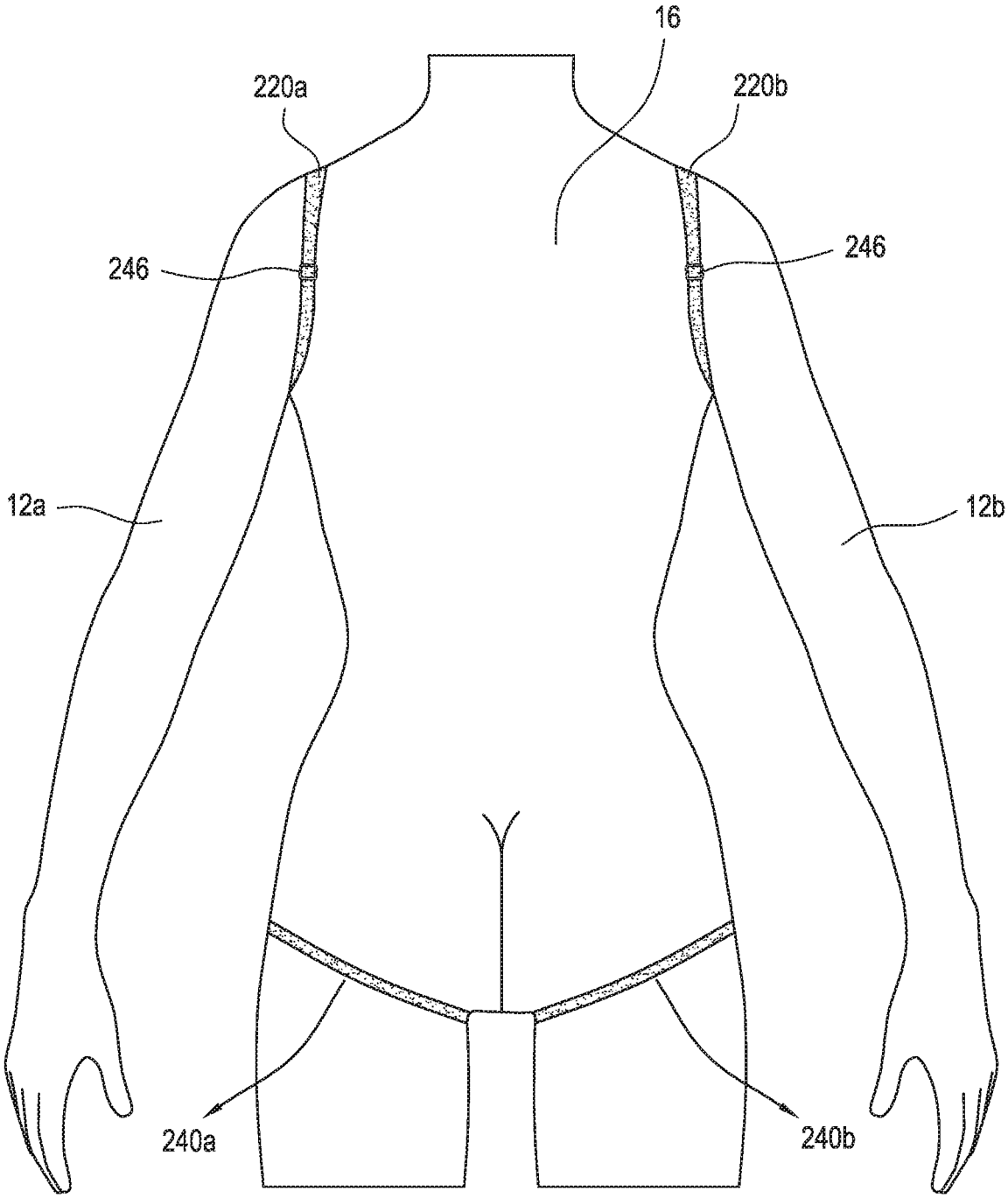

The backless support bra in accordance with a second embodiment of the present invention is illustrated in FIGS. 8 and 9 of the drawings.

The backless support bra 200 in accordance with this second embodiment includes structure and features that exist and that have been described in connection with the already described first embodiment. Similarities and differences between the second and first embodiments will be described herein. A significant difference between the second and first embodiments is that bra 200 of the second embodiment includes a pair of self-reattaching lower straps. The self-reattaching lower straps are described below.

Referring to FIG. 8, which is a front view of the backless support bra in accordance with the second embodiment of the present invention, it is shown that bra 200 includes a front main panel 210, which includes left and right cups 212*a*, 212*b*, and upper shoulder straps 220*a*, 220*b*. These components of bra 200 have the same structure and function of the corresponding components of bra 100 of the first embodiment, that is, the same structure and function as front main panel 110, including left and right cups 112*a*, 112*b*, and upper shoulder straps 120*a*, 120*b* of bra 100. Therefore, a description of these components of the second embodiment is not provided, except where necessary for an understanding of the present invention. FIG. 8 includes various labelling of these components including first and second ends 222*a*, 224*a* of the left shoulder strap 220*a* and first and second ends 222*b*, 224*b* of the right shoulder strap 220*b*, upper edges 214*a*, 214*b* of the left and tight cups 212*a*, 212*b*, and lower edges 216*a*, 216*b* of the left and right cups 212*a*, 212*b*. The functions of these ends and edges are understood given the description herein.

Bra 200 of the second embodiment includes a pair of lower straps 240*a*, 240*b* that differ from lower straps 140*a*, 140*b* of bra 100 of the first embodiment. As shown in FIG. 8, left and right lower straps 240*a*, 240*b* of bra 200 have a crisscrossed type configuration, where it is shown that the straps intersect one another, when worn by a wearer, at or near the center of the stomach region of the wearer. As described in greater detail below, each of the left and right lower straps 240*a*, 240*b* extends downward from front main portion 210 towards the opposite leg of the wearer, around the wearer's legs (near the top region of each leg, at the hip), around the lower part of the buttocks of the wearer (see rear view of FIG. 9), extends through the pelvic region of the wearer (see FIG. 9) (extending through the pelvic region from the wearer's back to the wearer's front), and then extends upward along the wearer's upper leg (in front) and attached to a mid-portion of the same lower strap, as shown in FIG. 8. The pelvic region herein is the lower part of the trunk of the human body between the abdomen and the thighs (sometimes also called pelvic region of the trunk). As illustrated in FIGS. 8 and 9, the left and right lower straps 240*a*, 240*b* do not connect or attach to one another.

A more detailed discussion of the left and right lower straps 240*a*, 240*b* of bra 200 is now presented. It is noted that the terms "left" and "right" in connection with lower straps 240*a*, 240*b* are provided for convenience, wherein the left lower strap 240*a* is structured to go around the wearer's left leg, and right lower strap 240*b* is structured to go around the wearer's right leg. However, due to the crisscrossing of the lower straps around the wearer's stomach area, left lower strap 240*a* is attached to the right cup 212*b* and the right lower strap 240*b* is attached to the left cup 212*a*.

The left lower strap 240*a* includes a first end 242*a* that is connected to the right cup 212*b* at the cup's lower edge 216*b*. Left lower strap 240*a* extends downward towards the opposite leg. That is, left lower strap 240*a* extends from the right cup 212*b*, which is supporting the wearer's right breast when worn, towards the wearer's left leg. Hence, when worn, the left lower strap extends across the wearer's stomach region. As shown in FIG. 8, the left lower strap 240*a* extends to the upper portion of the wearer's left leg and then extends around the outer portion of that leg towards the wearer's back region. As shown in FIG. 9, the left lower strap 240*a* extends around the rear of the left leg toward the wearer's pelvic region, and then through the pelvic region, thus returning back to the wearer's front. Returning to FIG. 8, it is shown that the left lower strap continues to extend from the pelvic region up to a termination end 244*a*. End 244*a* of the left lower strap attaches to a mid-portion of the left lower strap, as shown in FIG. 8.

End 244*a* of the left lower strap is also called herein the strap's second end. The second end 244*a* of the left lower strap includes an attachment mechanism to enable it to be attached to a part of the left lower strap at the location shown in FIG. 8. The attachment mechanism may be a hook or other appropriate device. Hence, when properly worn, the left lower strap extends downward from the right cup 212*b* across the stomach and then encircles the left leg of the wearer. Encircling the leg is sometimes referred to herein as a leg loop.

The right lower strap 240*b* has the same structure as left lower strap 240*a*, but in mirror image, wherein the right lower strap's first end 242*b* end is attached to the bra's left cup 212*a*, at the position shown in FIG. 8. The right lower strap 240*b* extends downward and across the wearer's stomach, when worn, towards the wearer's right leg, and then extends around the outer portion of the right leg towards the wearer's back region. As shown in FIG. 9, the right lower strap 240*b* extends around the rear of the right leg toward the wearer's pelvic region, and then through the pelvic region, thus returning back to the wearer's front. Returning again to FIG. 8, it is shown that the right lower strap continues to extend from the pelvic region up to a termination end 244*b*. End 244*b* (also called second end 244*b*) of the right lower strap attaches to a mid-portion of the right lower strap, as shown in FIG. 8. Like the left lower strap, right lower strap 240*b* includes at its second end 244*b* an attachment mechanism, such as a hook, to enable it to connect to a mid-portion of the right lower strap.

As illustrated in FIGS. 8 and 9 of this second embodiment of the present invention, each of the left and right lower straps 240*a*, 240*b* extends downwardly, when the bra is worn, from the front main panel 210, around a respective leg, through the wearer's pelvic region (from the rear to the front of the wearer), and then upward and attached (or re-attached) to a mid-portion of the same lower strap. That is, the right lower strap reconnects to itself, and likewise, the left lower strap reconnects to itself.

In a variation, each of the left and right lower straps extend, when worn, from a respective cup of the bra downward to the pelvic region and through the pelvic region of the wearer (from the front to the rear of the wearer), then around the back of the legs (at or near the buttocks area) and then connected to the respective strap.

Thus, as illustrated in FIG. 8, the lower straps of bra 200 can be connected in two different manners when a wearer puts on bra 200 of the present invention. In one manner, the wearer can extend each of the lower straps first around the legs (from outer legs to inner legs) and through the pelvic region (from back to front) and then attach each of the lower straps at termination ends 244*a* and 244*b*. Or, in the other manner/technique/version described herein, the wearer can extend each of the lower straps first through the pelvic region (from front to back) and then around the legs (from inner legs to outer legs), and then attach the lower straps at termination ends 244*a* and 244*b*.

Bra 200 of the second embodiment further includes a set of sliders 246, as shown in FIG. 8, along the lower straps 240*a*, 240*b* to allow the wearer to adjust the lengths of different portions of the lower straps. Sliders 246 are well known length adjustment mechanisms. Other appropriate length adjustment mechanisms may be employed. Also, in variations of that shown in FIG. 8, bra 200 may include more or fewer length adjustment mechanisms, and may include such length adjustment mechanisms also in the upper shoulder straps 220*a*, 220*b*. Hence, bra 200 of the second embodiment (as well as all of the other embodiments described herein) may include any number of length adjustment mechanisms (including none) within any of the straps described. As is well known in the art, such mechanisms allow for comfort, to accommodate different body sizes/shapes, and other known benefits.

With respect to all of the benefits of bra 200 of the second embodiment of the present invention, all of benefits described herein with respect to bra 100 of the first embodiment are also applicable to the second embodiment.

The bra 200 also, due to its crisscrossed configuration, as described herein, achieves a desired shifting of the wearer's breast towards the center of the chest, which accentuates cleavage.

Moreover, as illustrated from the rear view of the second embodiment shown in FIG. 9, in comparison with FIG. 3 (which shows the rear view of bra 100 of the first embodiment), bra 200 provides the wearer with a completely unobstructed view of the wearer's entire lower back region and also the wearer's mid and upper buttocks region. As described herein, the lower straps 240*a*, 240*b* of bra 200 extend around the wearer's legs and through the pelvic region as shown in FIGS. 8 and 9. With such structure, bra 200 is supported on its lower ends, that is, front main panel 210 of bra 200 is fully supported downward in a manner wherein the only portion of the bra visible from the back of the wearer is that shown in FIG. 9. Accordingly, the wearer is afforded the ability to wear any article of clothing suitable to provide a completely unobstructed view of the wearer's back, upper buttock region, and mid-buttock region, if desired. Other advantages and features are like those described with respect to the various embodiments described herein.

Still further, bra 200 of the second embodiment may include any of the variations previously described with respect to bra 100. These include, for example, the different materials, shapes and other variations and features mentioned herein.

Third Embodiment: Backless Support Bra with Thong Panty

Backless support bra 300 according to a third embodiment of the present invention is illustrated in FIGS. 10-14.

Bra 300 is highly similar to bra 100 of the first embodiment, but includes an integrated panty (underwear) 360. As shown in FIGS. 10-14, bra 300 includes panty 360, which itself includes a front panty panel 360A and a rear panty panel 360B, to be described.

Figure 10:
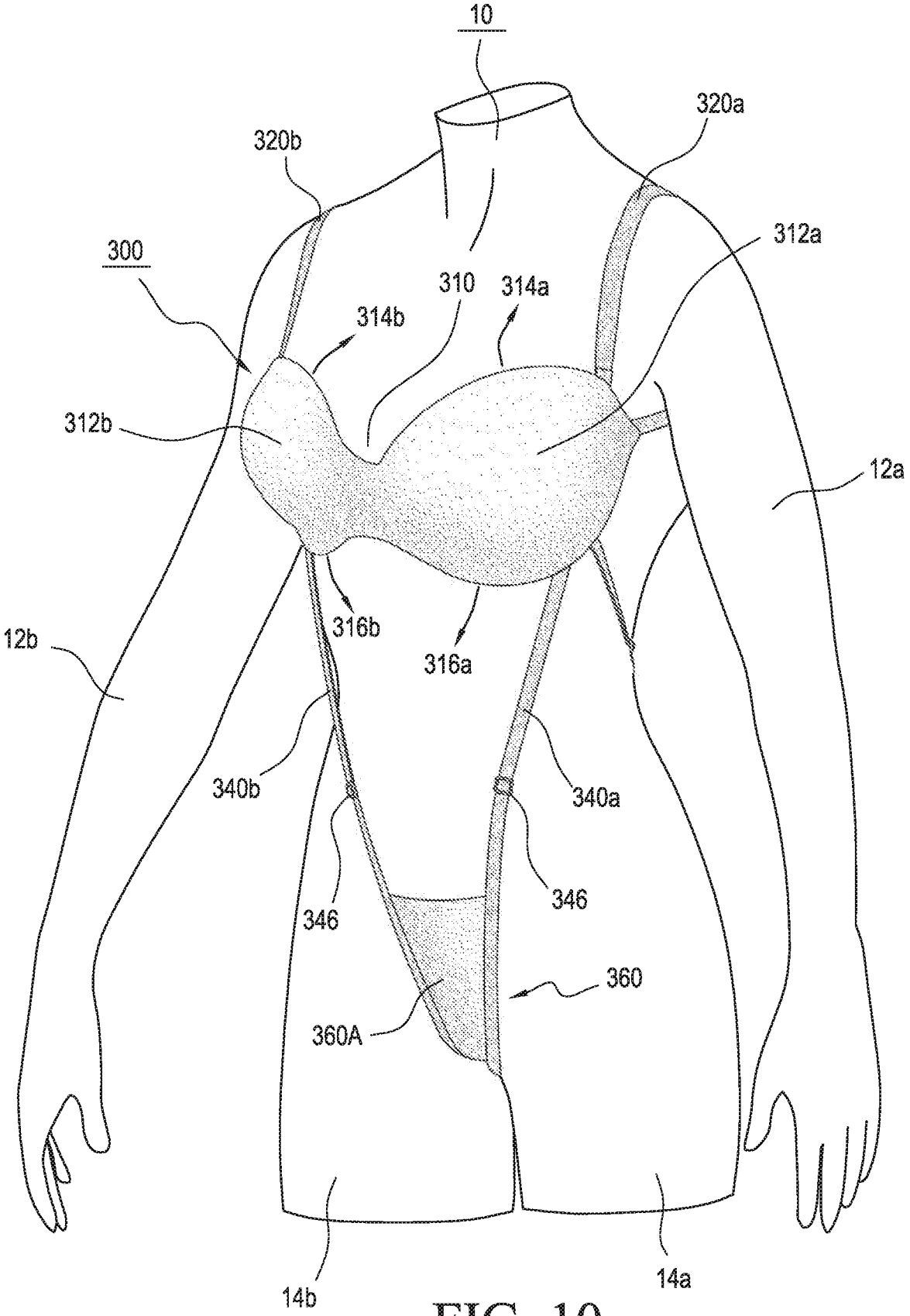

Referring first to FIG. 10, bra 300 includes a front main panel 310 with left and right cups 312*a*, 312*b*. Bra 300 also includes a pair of upper shoulder straps 320*a*, 320*b*, with the shoulder straps attached to the upper edges 314*a*, 314*b* of the two cups 312*a*, 312*b*, as shown in FIG. 10. Bra 300 also includes a pair of lower straps 340*a*, 340*b* that are attached to the lower edges 316*a*, 316*b* of the two cups 312*a*, 312*b*, as also shown in FIG. 10.

The structure and function of bra 300's front main panel 310, cups 312*a*, 312*b*, upper shoulder straps 320*a*, 320*b*, and lower straps 316*a*, 316*b* are the same as the corresponding components of bra 100 of the first embodiment. Therefore, details of these elements/structures and their respective functions (and possible variations) are not repeated herein.

Figure 11:
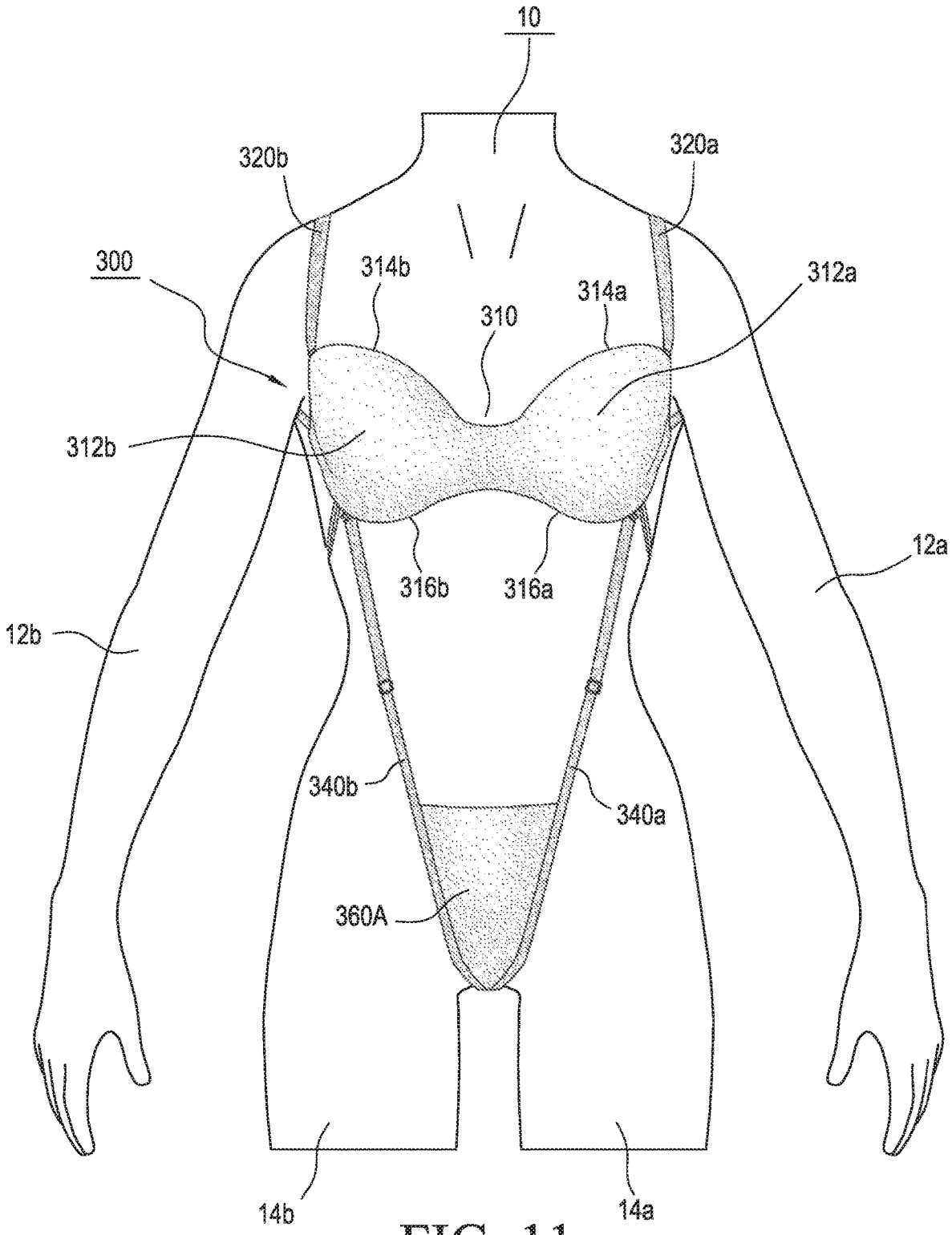

Bra 300 includes an integrated panty 360 with a front panty panel 360A and a rear panty panel 360B, with each of these panty panels interconnected and extending between the bra's two lower straps 340*a*, 340*b*. As shown in FIGS. 10 and 11, front panty panel 360A extends between left lower strap 340*a* and right lower strap 340*b* in the lower stomach/pelvic area of the wearer, when worn. Similarly, as shown in FIG. 12, the rear panty panel 360B extends between the left lower strap 340*a* and the right lower strap 340*b* in the buttock area of the wearer, when worn.

Panty panel 360A, 360B are structured to operate as a thong-style undergarment, and the amount of material, size, dimension and stretch-ability (if any) are selected based on the size/shape of the intended wearer and other desired characteristics. For instance, as a thong-style undergarment, panty panels 360A, 360B of bra 300 are configured to extend between the respective portions of left and right lower straps 340*a* and 360*b* in order to avoid or, at least, minimize panty lines, and to provide other beneficial characteristics typical of thong underwear.

Figure 12:
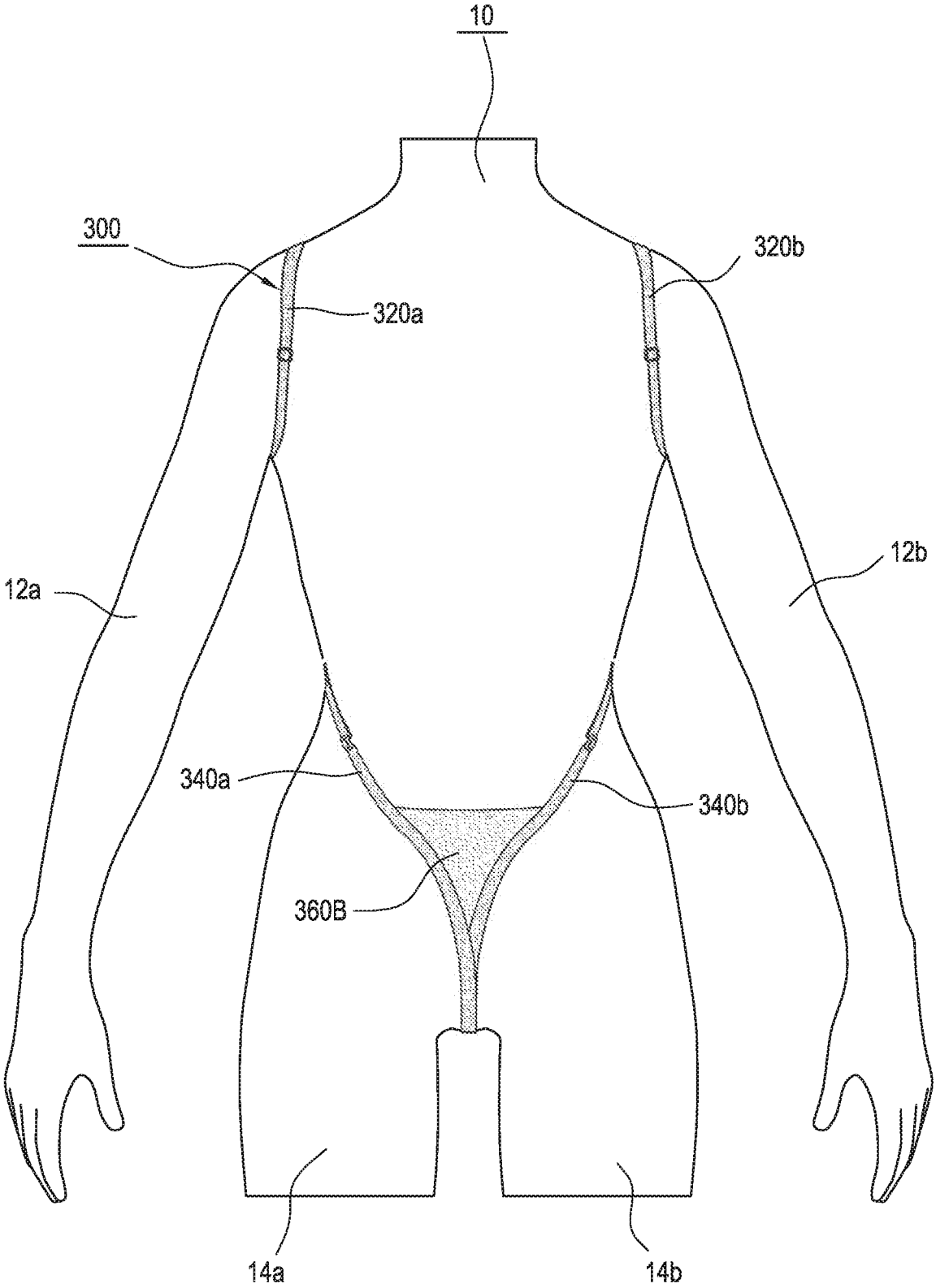
Figure 13:
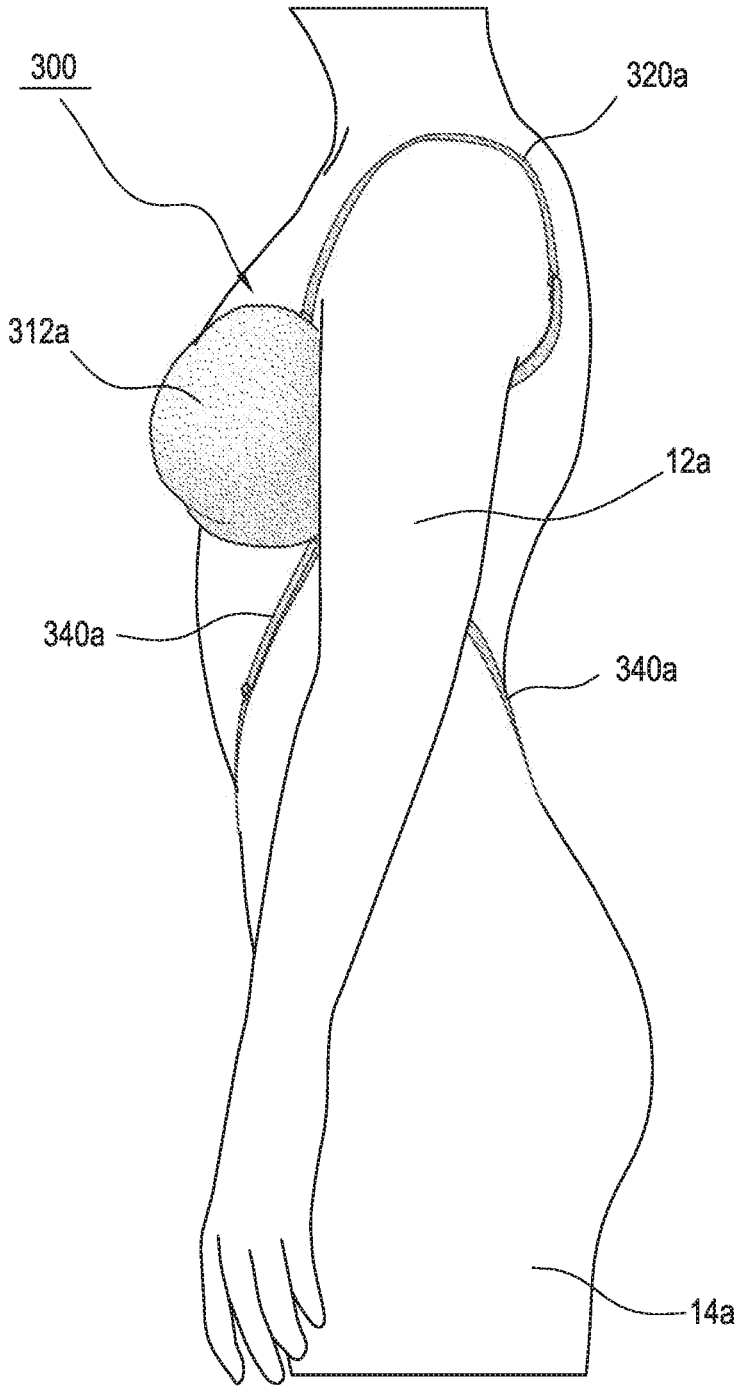
Figure 14:
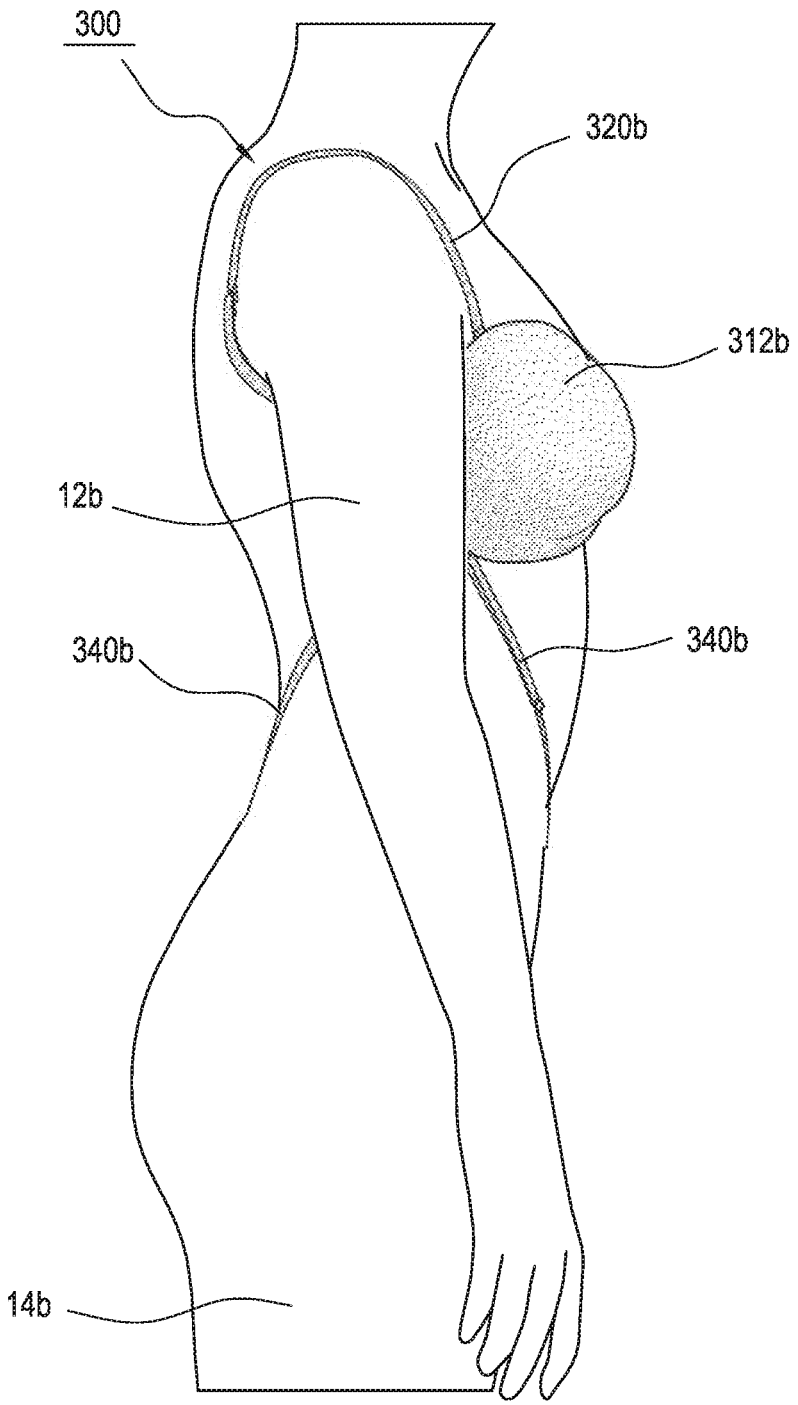

The front and rear panty panels 360A, 360B are particularly shown in FIGS. 10-12, but the invention includes variations of that shown in these figures. In a variation, one or both of the panty panels 360A, 360B extend further upward on the wearer, when worn. Thus, in the variation, more of the wearer's front pelvic area is covered, when worn, than that shown in FIG. 11. In another variation, more of the wearer's buttocks is covered, when worn, than that shown in FIG. 12. In yet a further variation, one or both of the panty panels 360A, 360B covers less of the front pelvic area and/or the buttocks shown in FIGS. 11 and 12. Thus, the invention includes panty panels that cover any amount of a wearer's pelvic area and any amount of the wearer's buttocks.

The front and rear panty panels 360A, 360B, in any of the variations, are joined/attached to the various portions of the lower straps by stitching or other suitable technique. The panty panels can each be of a unitary one-piece integral construction or have multiple portions sewn together (or connected in other appropriate manners). Like the other portions of the bra, the front and rear panty panels may be made of any natural or synthetic fibers. The panty panels may, if desired, be made of lace or lace-like material, or be made of other material with a lace or lace-like covering. As with known panties, any number of materials or coverings may be employed for various purposes, such as comfort and/or aesthetics.

Bra 300 of the second embodiment further includes a set of sliders 346, as shown in FIG. 10, along the lower straps 340*a*, 340*b* to allow the wearer to adjust the lengths of different portions of the lower straps.

Given the structure of bra 300, it is appreciated that bra 300 is easily put on and taken off. To put on, the wearer steps into the leg loops formed by the left lower strap 340*a* and the right lower strap 340*b*, and raises the two upper shoulder straps (320*a*, 320*b*) until they are disposed over the wearer's shoulders.

Preferably, the panty panels, bra cups, and upper shoulder straps are formed of an elastic material that provide a convenient and comfortable level of resiliency.

Bra 300 of the third embodiment of the invention provides a substantially unobstructed view of the wearer's back, and all other benefits and features already described with respect to bra 100 of the first embodiment. Moreover, all of the variations described herein with respect to the first embodiment are equally applicable to this third embodiment. In addition, with an integrated thong-style panty, bra 300 represents an all-in-one type undergarment that can be worn with numerous types of other clothing, including any of the dresses herein mentioned as well as any type of dress, skirt (e.g., skirt with high side slip(s)), pants, etc.

Fourth Embodiment: Backless Support Bra with Full-Coverage Panty

Backless support bra 400 according to a fourth embodiment of the present invention is illustrated in FIGS. 15-21. Bra 400 is highly similar to bra 300 of the third embodiment, but rather than having an integrated thong-style panel, bra 400 includes an integrated fill-coverage panty.

Figure 15:
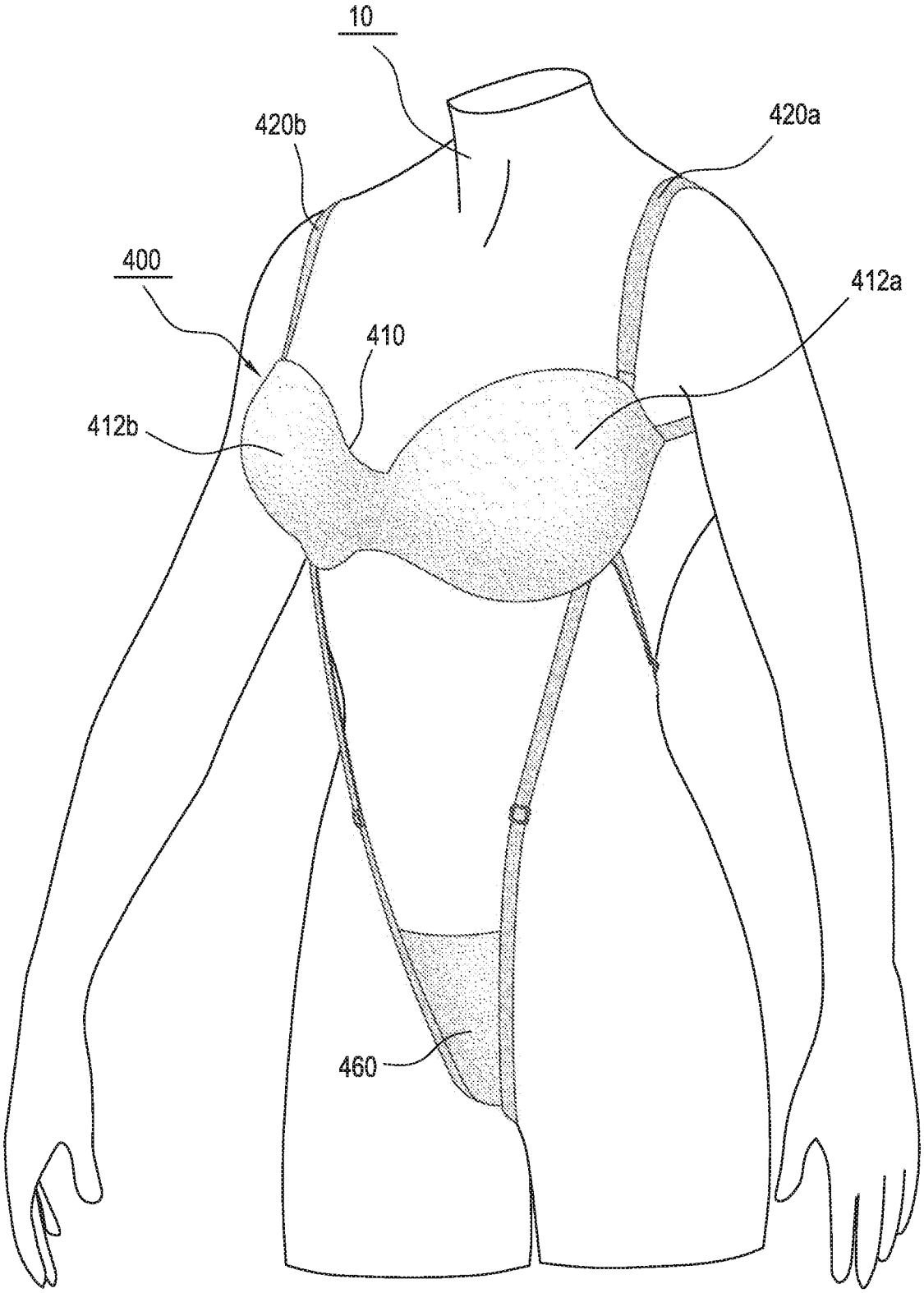
Figure 16:
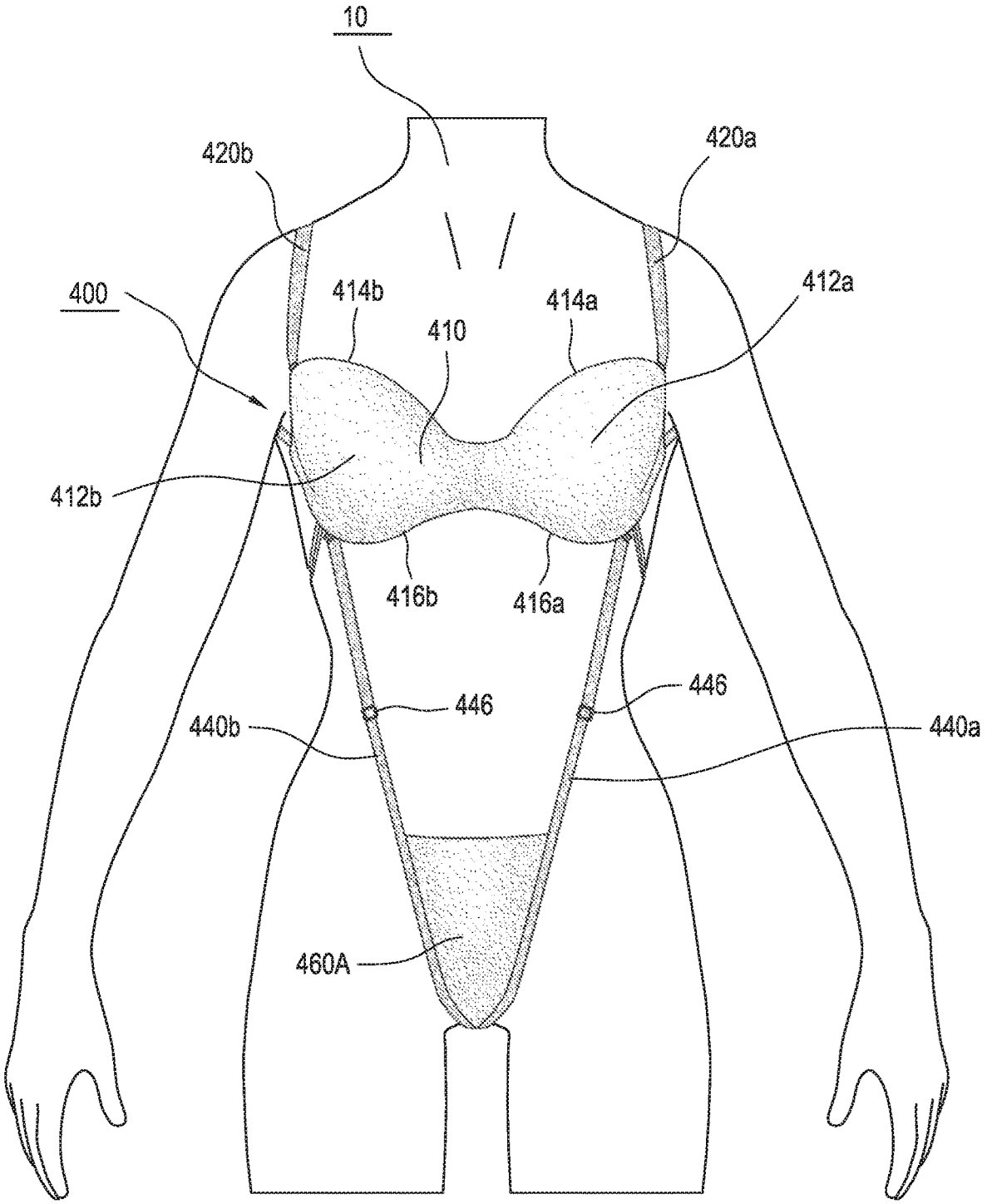

As shown in FIGS. 15 and 16, bra 400 has a front main panel 410 with left and right cups 412*a*, 412*b*. Bra 400 also includes a pair of upper shoulder straps 420*a*, 420*b*, attached to upper edges 414*a*, 414*b* of the two cups 412*a*, 412*b*, and a pair of lower straps 440*a*, 440*b* attached to lower edges 416*a*, 416*b* of the two cups 412*a*, 412*b*.

The structure and function of bra 400's front main panel 410, cups 412*a*, 412*b*, upper shoulder straps 420*a*, 420*b*, and lower straps 416*a*, 416*b* are the same as the corresponding components of both bra 100 of the first embodiment and bra 300 of the third embodiment. The details of these components have already been described at least in connection with bra 100 of the first embodiment. Therefore, details of these elements/structures and their respective functions (and possible variations) are not repeated herein.

Bra 400 includes a full-coverage panty 460. Panty 460 includes a front panty panel 460A and a rear panty panel 460B. The front panty panel 460A is the same as front panty panel 360A of bra 300 of the third embodiment, and thus a detailed discussion of front panty panel 460A is omitted. However, as with front panty panel 360A, front panty panel 460A may extend upward higher or lower than that shown in FIGS. 15 and 16.

Figure 17:
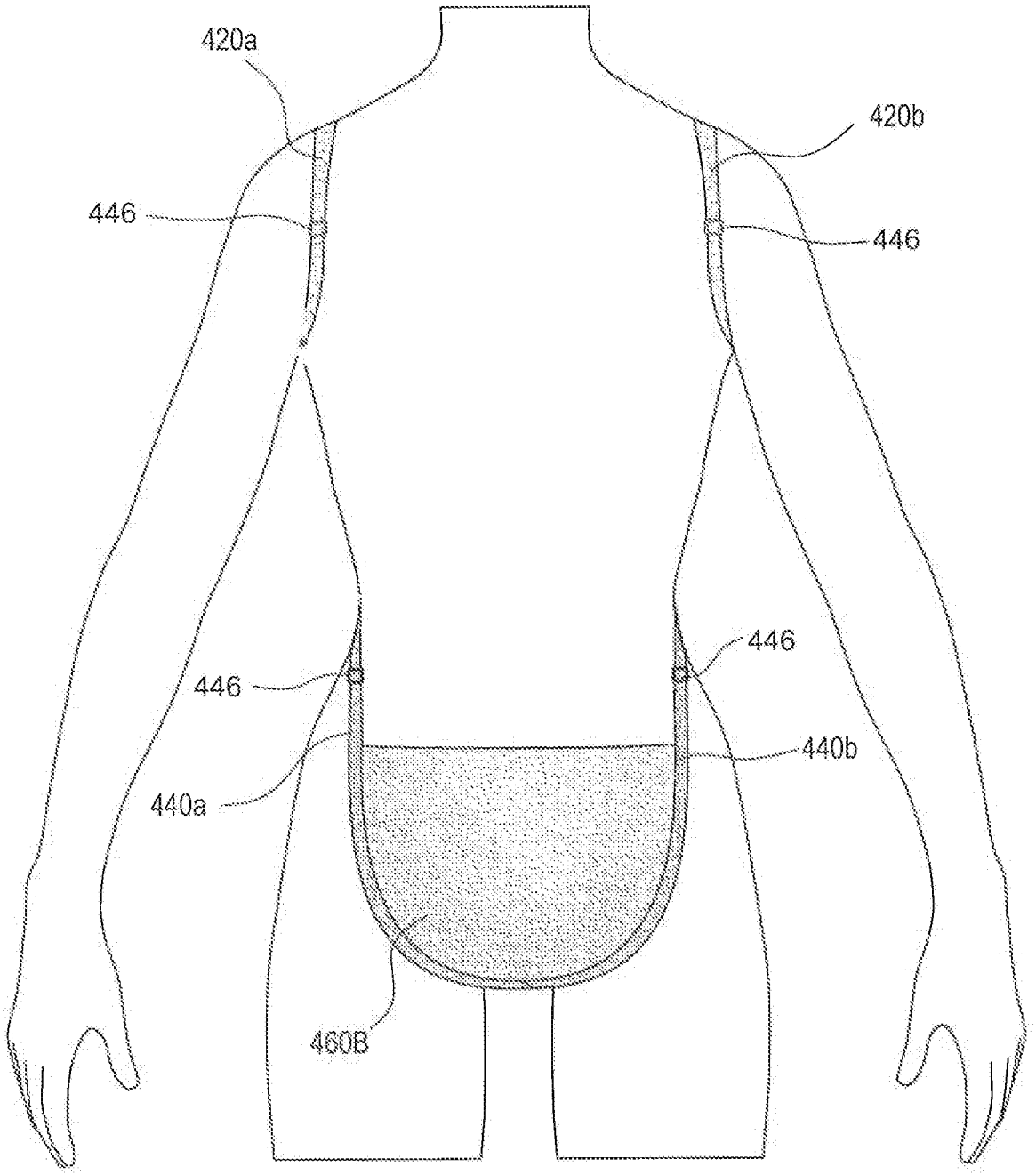
Figure 18:
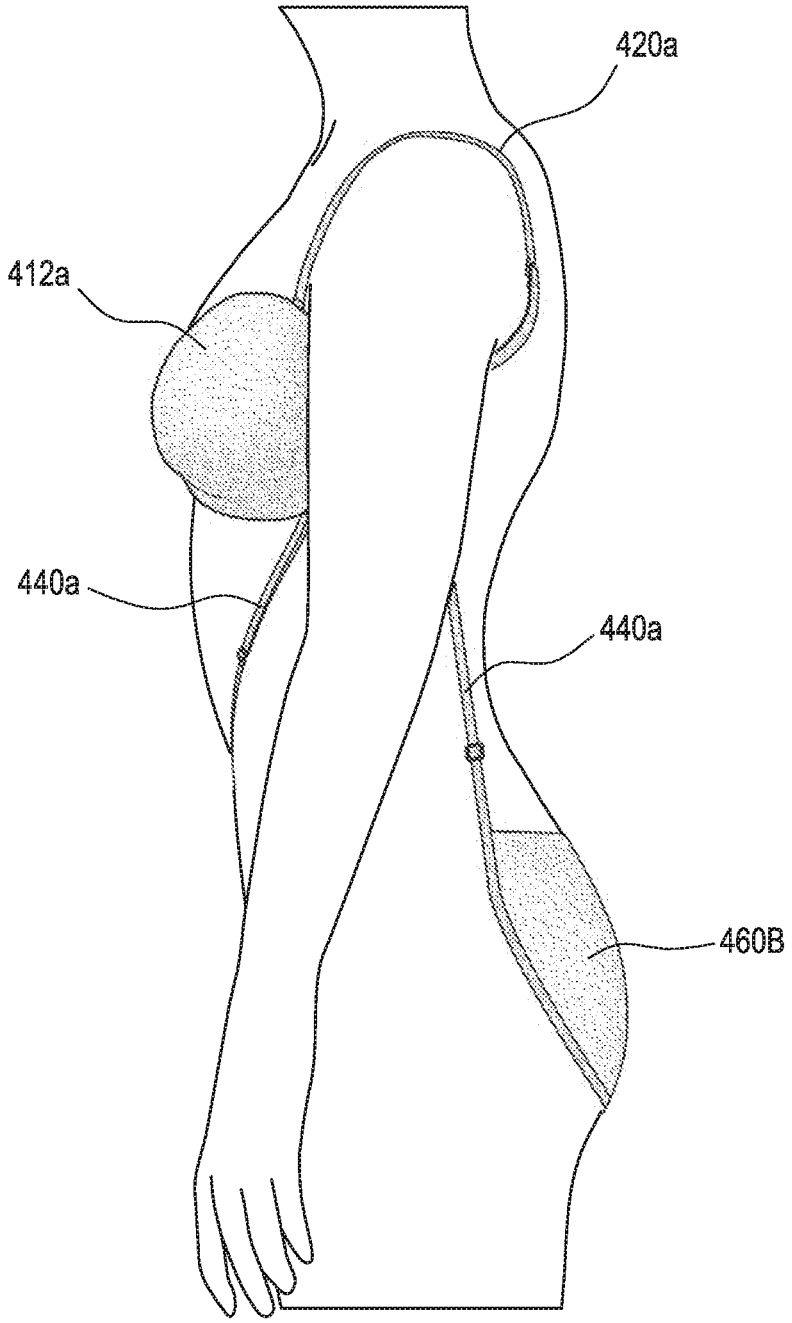
Figure 19:
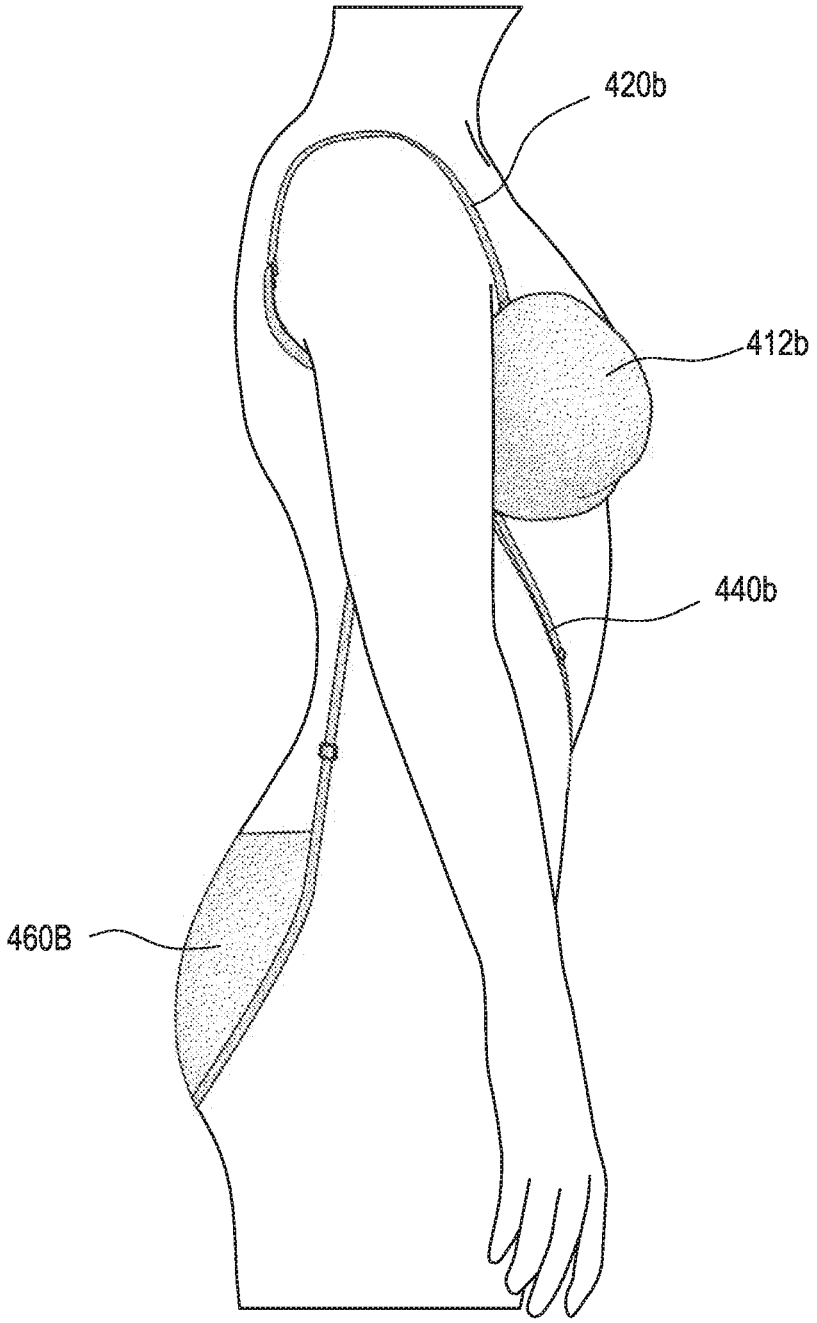
Figure 20:
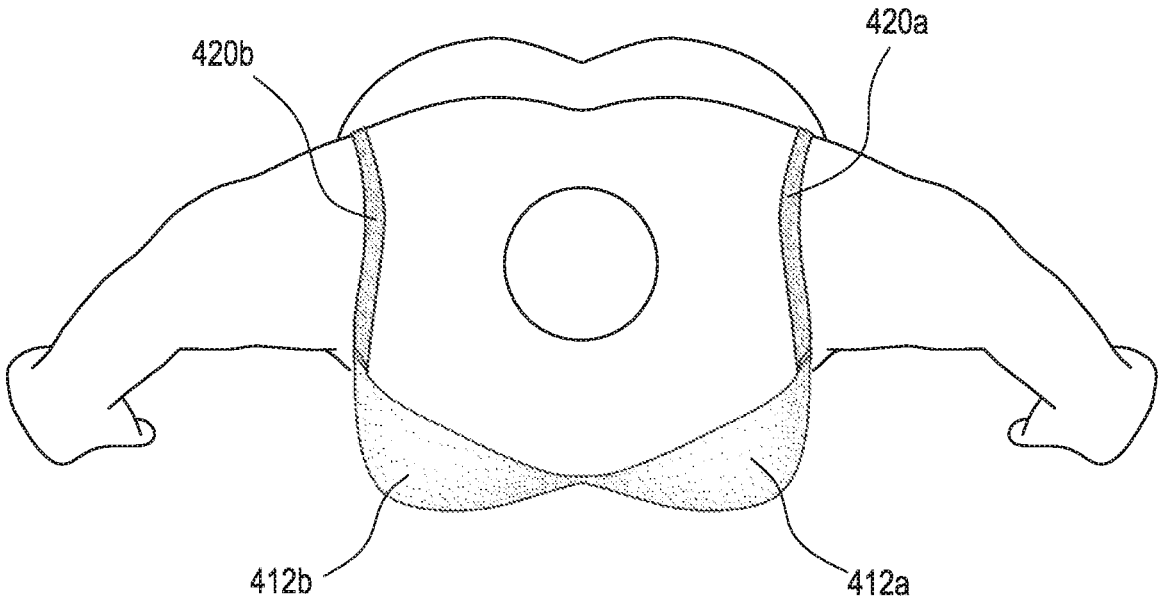
Figure 21:
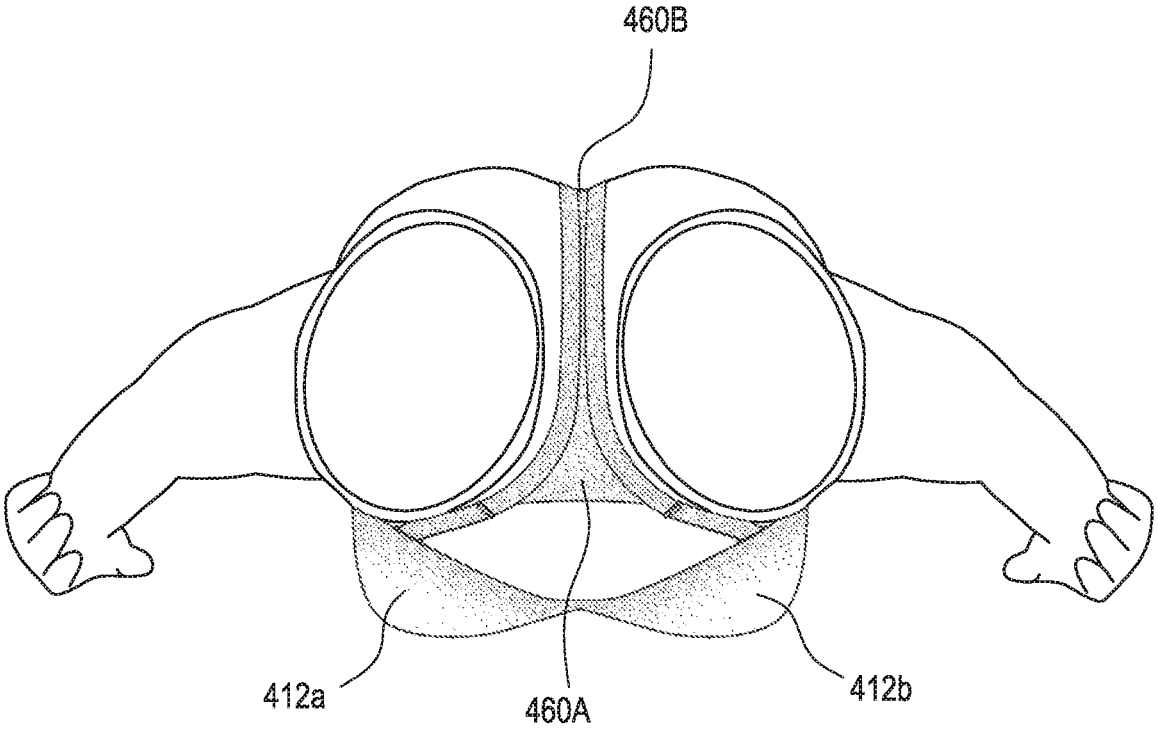

Rear panty panel 460B is shown in FIG. 17, and partially shown in the side views of FIGS. 18 and 19. Rear panty panel 460B extends between a portion of the left lower strap 440*a* and a portion of the right lower strap 440*b* in the buttock area of the wearer, when worn. As illustrated, rear panty panel 460B is a full-coverage style and provides the features and benefits of typical full-coverage style panties.

The rear panty panel 460B is particularly shown in FIGS. 17-19, but the invention includes variations of that shown in these figures. In a variation, rear panty panel 460B extends further upward on the wearer, when worn. Thus, in the variation, more of the wearer's buttocks area is covered, when worn, than that shown in FIG. 17. In another variation, less of the buttocks area is covered than that shown in FIG. 17. As already discussed with respect to bra 300, the front panty panel 460A also can be different in size/shape than that shown in the figures.

The panty of bra 400 also may be configured to provide different styles based on criteria such as the amount of rear coverage, width at the sides and height at which they are worn, and may also be in the style of a leg panty. Panty 460 also can be made of a variety of materials and fabrics, including satin, silk, PVC, cotton, nylon, mesh, lace, rawhide, leather, latex, Lycra™, polyester, other material mentioned herein, or other appropriate known material.

As with the other embodiments already described, sliders 446 are provided to enable the wearer to adjust the length of the various straps. Fewer or more sliders can be provided, as desired.

The front and rear panty panels 460A, 460B may be distinct components or may be a single unitary component, and may be interconnected with the lower straps in any manner herein described. In another variation, panty 460 is removable from the remainder of bra 400 and is attachable to such remainder via hook and fastener technique, snap-type fasteners, or other appropriate temporary attachment mechanism. With a separable panty, bra 400 can be used with different types of panties (or none) to provide the benefits/features of different looks, different styles, different levels of comfort, as well as the ability to wash the components separately, if desired.

As described above with respect to bra 300 of the third embodiment, bra 400 may include any of the variations previously described with respect to bra 100 or bra 300.

These include, for example, the different materials, shapes and other variations and features mentioned herein.

Fifth Embodiment: Backless Support Bra with Split Cups

Backless support bra 500 according to a fifth embodiment of the present invention is illustrated in FIGS. 22-28. As shown in these figures, and to be described in greater detail below, bra 500 includes non-connected cups to support the wearer's breasts in a manner that provides an unobstructed view of the wearer's center chest area. With such bra, the wearer is able to wear garments that have a plunging or other low-cut neckline. The bra also is "backless" as in the previously discussed embodiments.

Figure 22:
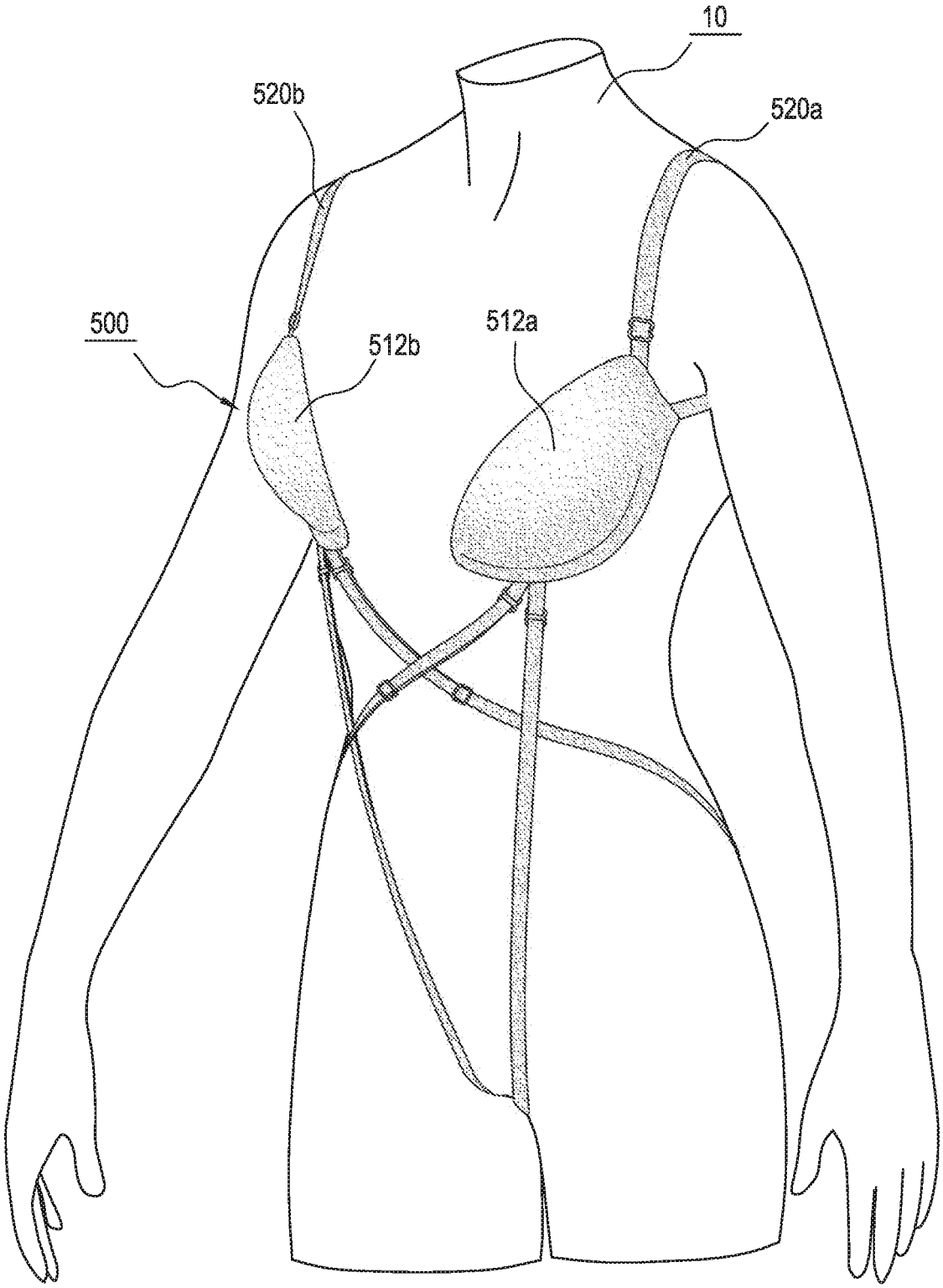
Figure 23:
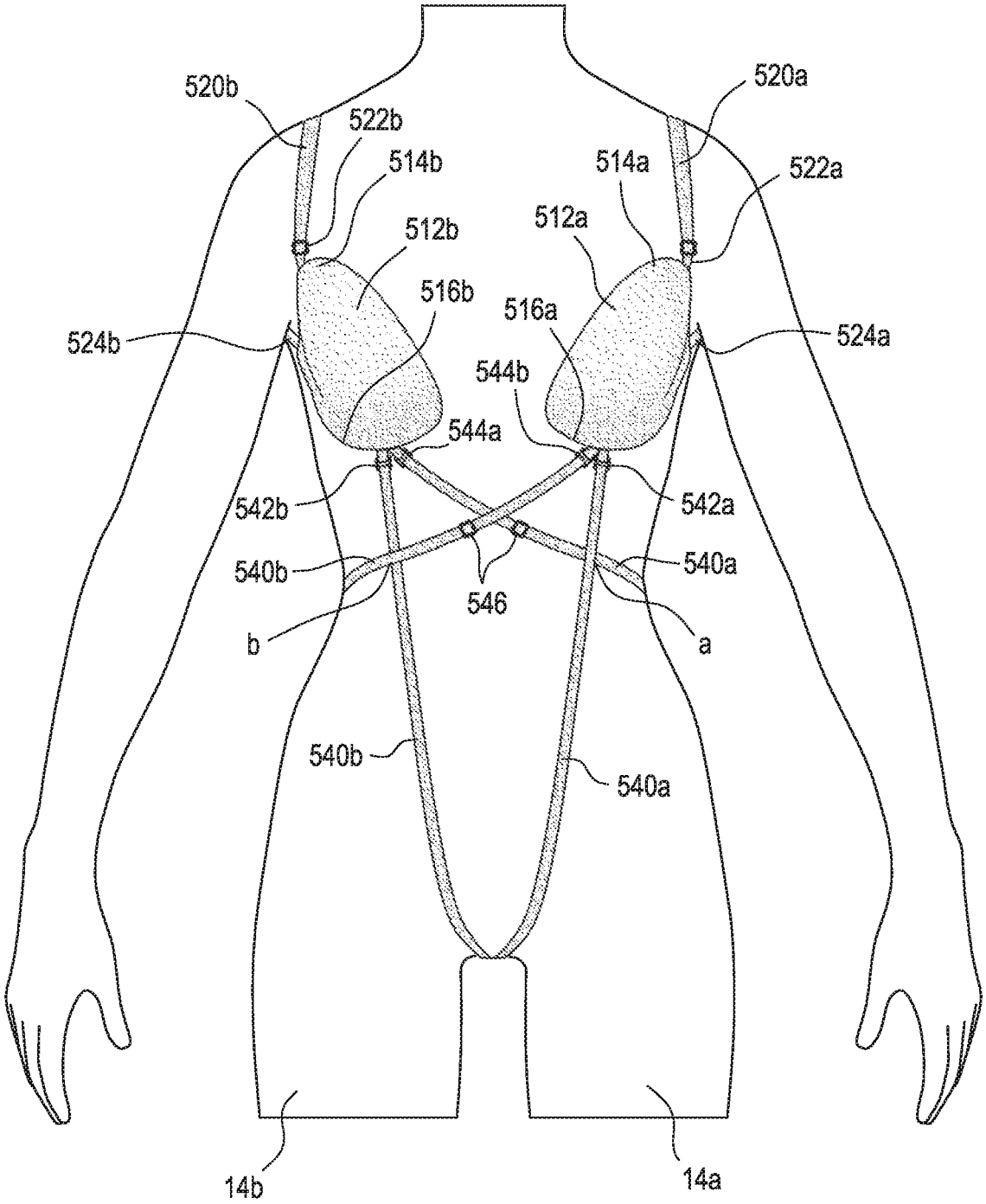

Referring to FIGS. 22 and 23, bra 500 includes left and right cups 512*a*, 512*b*, a pair of shoulder straps 520*a*, 520*b*, and a pair of lower straps 540*a*, 540*b*. Left and right cups 512*a*, 512*b* are not connected and sometimes are referred to herein as "split cups." Hence, bra 500 of this fifth embodiment does not include a front main panel having two cups, as in the previously described embodiments.

Figure 24:
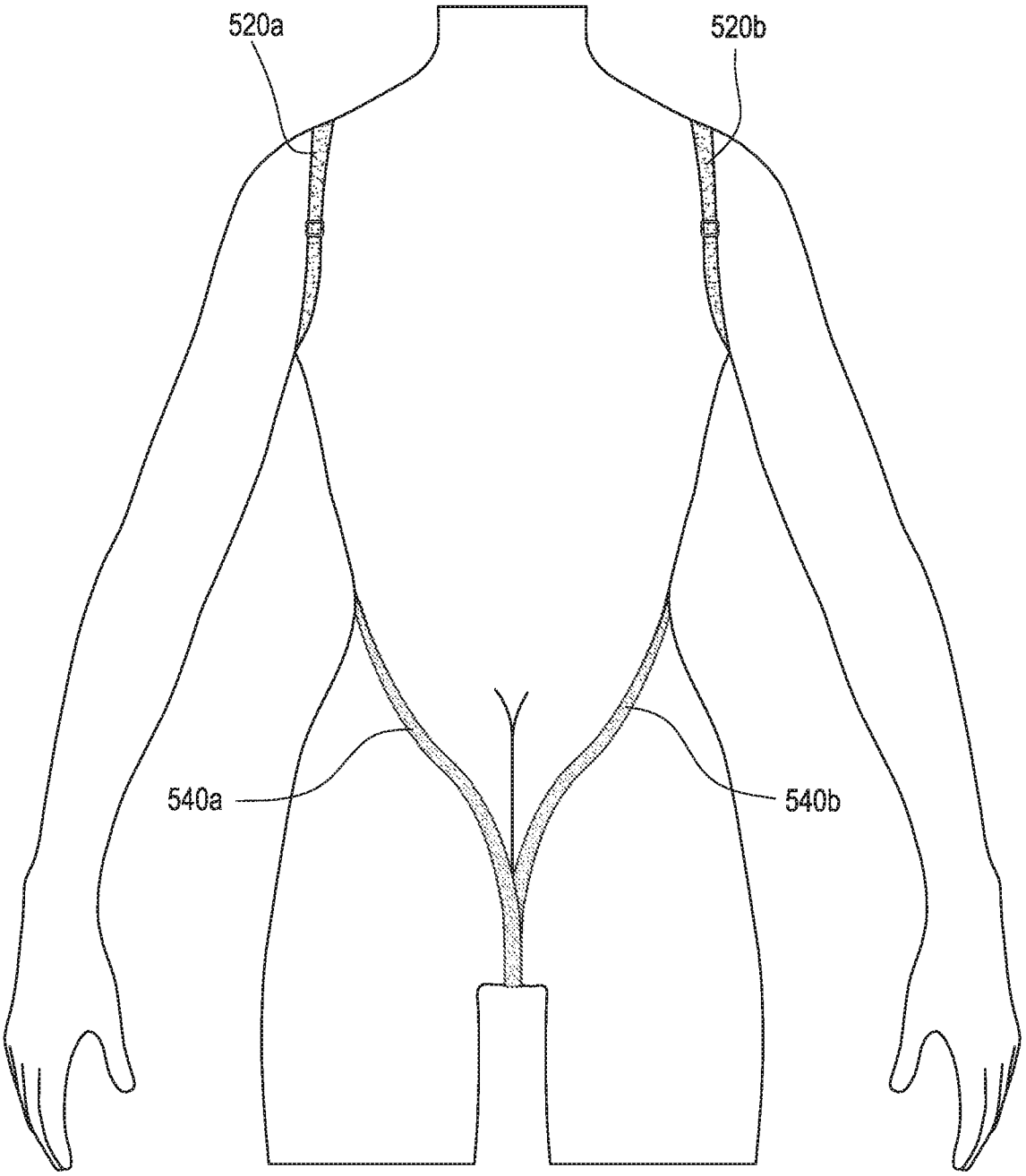
Figure 25:
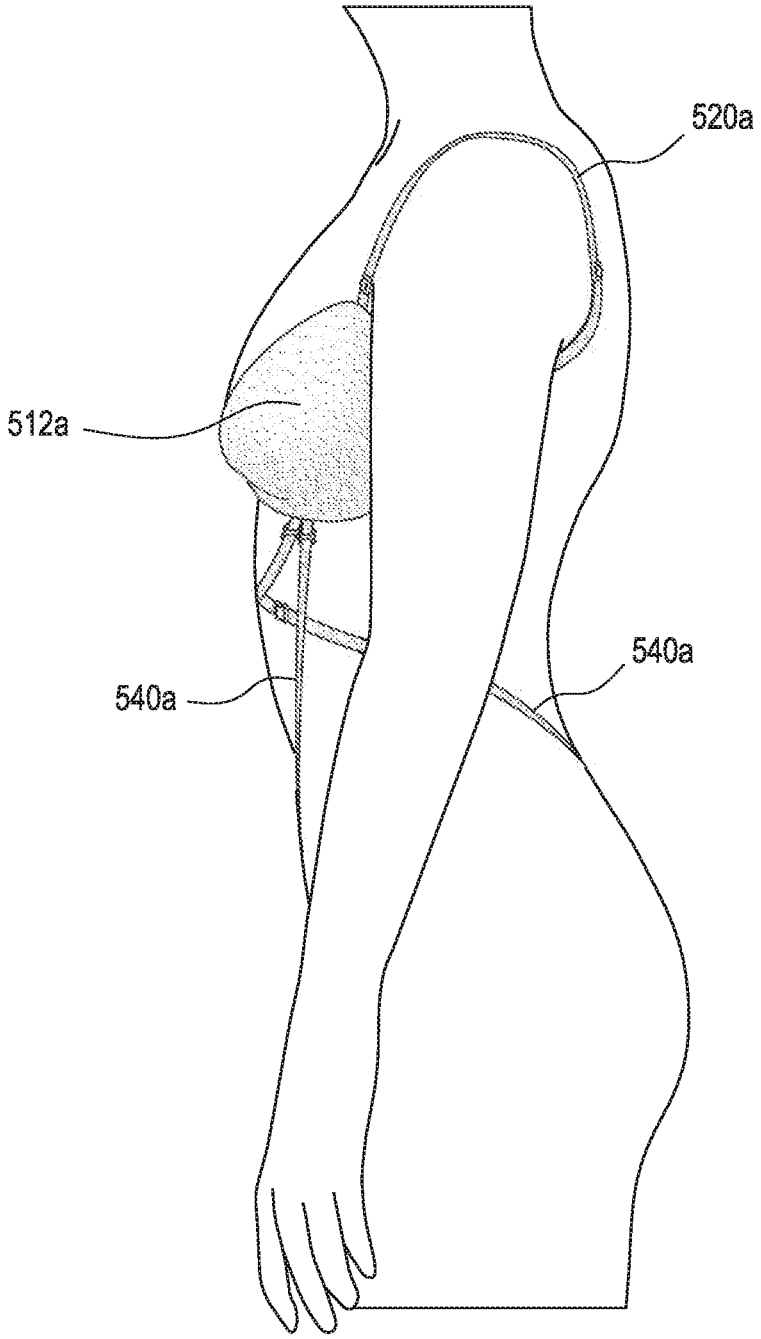
Figure 26:
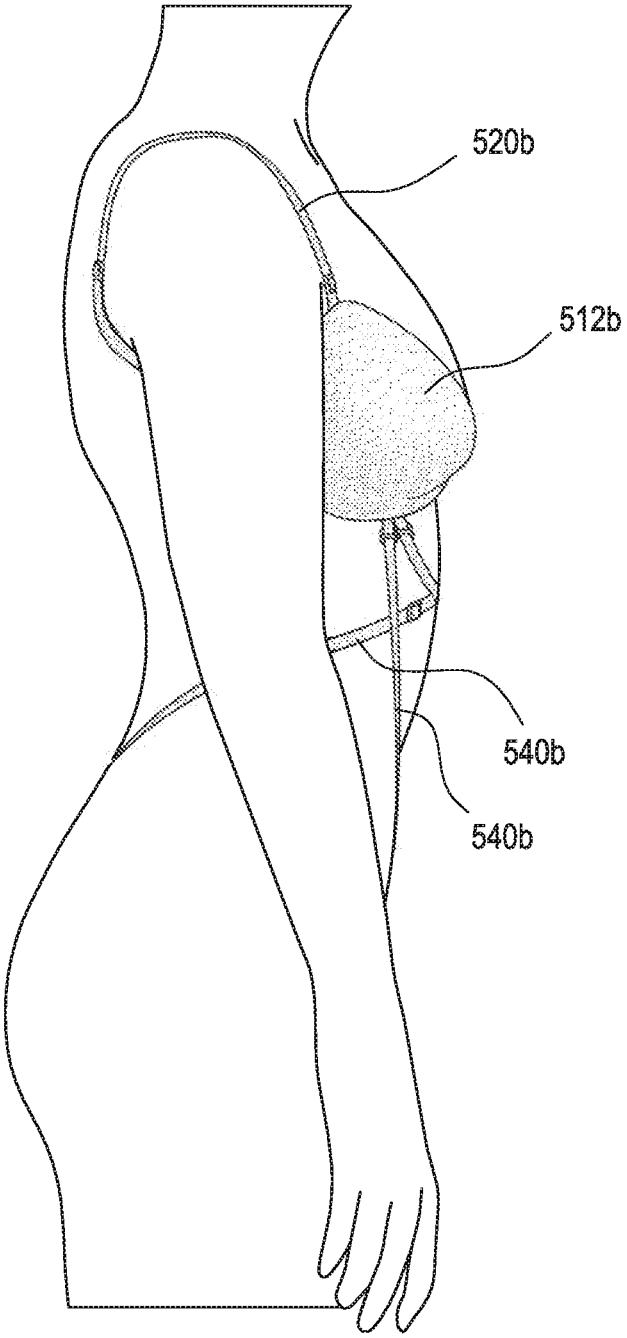
Figure 27:
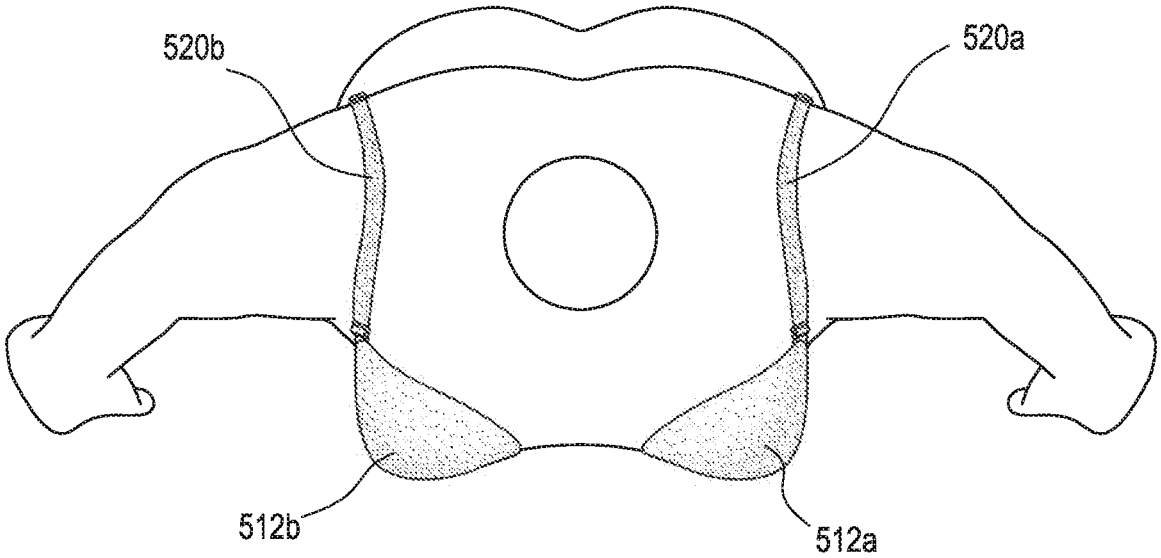

The left and right upper shoulder straps 520*a*, 520*b* are connected to the left and right cups, respectively, as shown in FIGS. 22 and 23. Left shoulder strap 520*a* includes first and second ends 522*a* and 524*a*. Likewise, right shoulder strap 520*b* includes first and second ends 522*b* and 524*b*. Only FIG. 23 shows end 524*b* of the right shoulder strap 520*b*. As in the previously described embodiments, the straps go around the wearer's shoulder as shown in FIG. 24. The first ends of each shoulder strap attach to the respective cups at their upper edge 514*a*, 514*b*, as shown in FIG. 23. The second ends of each shoulder strap attach to the respective cups near the first attachment points, also as shown in FIG. 23. However, the specific locations of attachment may be different than that particularly shown in the figures.

The function, size, materials and other characteristics of the upper shoulder straps of bra 500 are as described in the previous embodiments. The upper shoulder straps 520*a*, 520*b* may be modified in any of the manners mentioned herein with respect to the various embodiments described.

Bra 500 includes two lower straps 540*a*, 540*b*, and are identified herein, for convenience, as left lower strap 540*a* and right lower strap 540*b*. Left lower strap 540*a* includes first and second ends 542*a*, 544*a*, and right lower strap 540*b* includes first and second ends 542*b*, 544*b*. The structures of lower straps 540*a*, 540*b*, when bra 500 is worn, are shown in FIGS. 23 and 24, along with the side views of FIGS. 25 and 26, the top view of FIG. 27 and the bottom view of FIG. 28.

The first end 542*a* of left lower strap 540*a* is attached to the left cup 512*a* at the left cup's lower edge 516*a*. The second end 544*a* of left lower strap 540*a* is attached to right cup 512*b* at the right cup's lower edge 516*b*. Similarly, the first end 542*b* of right lower strap 540*b* is attached to the right cup 512*b* at the right cup's lower edge 516*b*. The second end 544*b* of right lower strap 540*b* is attached to left cup 512*a* at the left cup's lower edge 516*a*.

When bra 500 is worn, the left and right lower straps extend along the wearer as follows. Referring again to FIG. 23, the left lower strap 540*a* extends from left cup 512*a* downward to the wearer's pelvic region and through the pelvic region to the wearer's buttocks area. Likewise, the right lower strap 540*b* extends from right cup 512*b* downward to the wearer's pelvic region and through the pelvic region to the wearer's buttocks area. Then, as shown in the rear view of FIG. 24, the left and right lower straps 540*a*, 540*b* extend upward across the wearer's buttocks, and around the wearer's waist area towards the wearer's front. As shown in FIG. 24, left lower strap 540*a* extends upward and around the left side of the wearer's waist to the front, and the right lower strap 540*b* extends upward and around the right side of the wearer's waist to the front.

Referring again to FIG. 23, left lower strap 540*a* (having extended from the back to the front around the left side of the wearer's waste) extends across the wearer's stomach (i.e., mid-section of the waist) and connects to the right cup 512*b*. Conversely, right lower strap 540*b* (also having extended from the back to the front around the right side of the wearer's waste) extends across the wearer's stomach (i.e., mid-section of the waist) and connects to the left cup 512*a*. As illustrated in FIG. 23, left lower strap 540*a* crosses itself at point "a" and right lower strap 540*b* crosses itself at point "b."

As shown in the figures and described herein, left lower strap 540*a*, when bra 500 is worn, extends around the uppermost part of the left leg of the wearer. Conversely, right lower strap 540*b* extends around the uppermost part of the right leg of the wearer. It is noted that the terms "left" and "right" in left lower strap 540*a* and right lower strap 540*b* are provided for convenience, and it is appreciated that the left lower strap is connected to both the left and right cups of bra 500. Likewise, the right lower strap is also connected to both the left and right cups.

Figure 28:
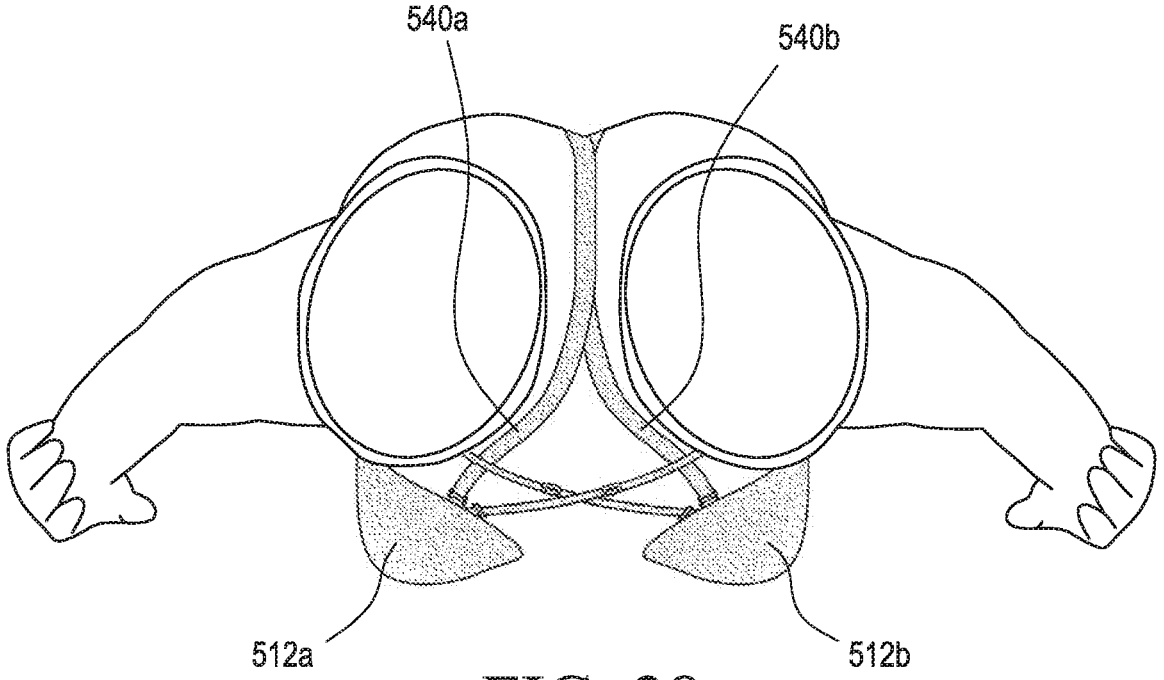

FIG. 28 shows a bottom view of bra 500 of the fifth embodiment of the present invention, when worn by a wearer. As shown, the left and right lower straps 540*a*, 540*b* generally are contacting one another in the wearer's pelvic region, although this may not be the case with certain individuals depending on size and other factors.

As with the other embodiments described, sliders 546 are provided to enable the wearer to adjust the length of the various straps. Fewer or more sliders can be provided, as desired.

Other features and variations previously described with respect other embodiments described herein are applicable to bra 500 of this fifth embodiment. For instance, the upper shoulder straps and/or the lower straps can be permanently affixed or attached to the respective cups, or, in variations, one or more of such straps can be detachable. As another example, the left and right cups can be lined, padded, or otherwise enhanced to provide additional support and/or enhancement. Silicone inserts or silicone strips may be included inside the left and rights cups to minimize slippage of a cup from the wearer's breast, and/or to provide other benefits/functions. Other variations described herein also are applicable to this embodiment.

In another variation, although generally not preferred, the left lower strap is connected at both ends to the left cup of bra 500 and right lower strap is connected at both ends to the right cup of bra 500. When worn, the configuration shown in FIGS. 23-27 still is applicable, except the two lower straps cross over one another in the wearer's pelvic region wherein the left lower strap extends from the left side at the wearer's front into the pelvic area and then comes out the rear side over the right side of the buttocks' region. Conversely, the right lower strap extends from the right side at the wearer's front into the pelvic area and then comes out the rear side over the left side of the buttocks' region. In this variation, the lower straps are reversed in the back view of FIG. 31.

As described, bra 500 of the present invention provides a wearer with various advantageous features, including providing support for the wearer's breasts in a manner that provides a completely unobstructed view of the wearer's back, as shown in FIG. 24, and, simultaneously, an unobstructed view of the wearer's center chest area, as shown in FIGS. 22 and 23. With such bra structure and configuration, the wearer of bra 500 can wear a garment with a low or very low (e.g., plunging) neck line without any portion of the bra being visible. Moreover, the wearer is further provided the ability of wearing a garment that is backless without any portion of the bra being visible from the back. Still further, the wearer can wear a garment that has both a low (or very low/plunging) neck line and also that is backless without any portion of the bra being visible from either the front or the back. Accordingly, numerous types of garments can be worn with bra 500 of the present invention.

Sixth Embodiment: Backless Support Bra with Split Cups Connected by a Neck Halter Backless support bra 600 according to a sixth embodiment of the present invention is illustrated in FIGS. 29-35. Bra 600 is highly similar to bra 500 described above, except bra 600 includes a single neck halter 620, rather than two shoulder straps.

Figure 29:
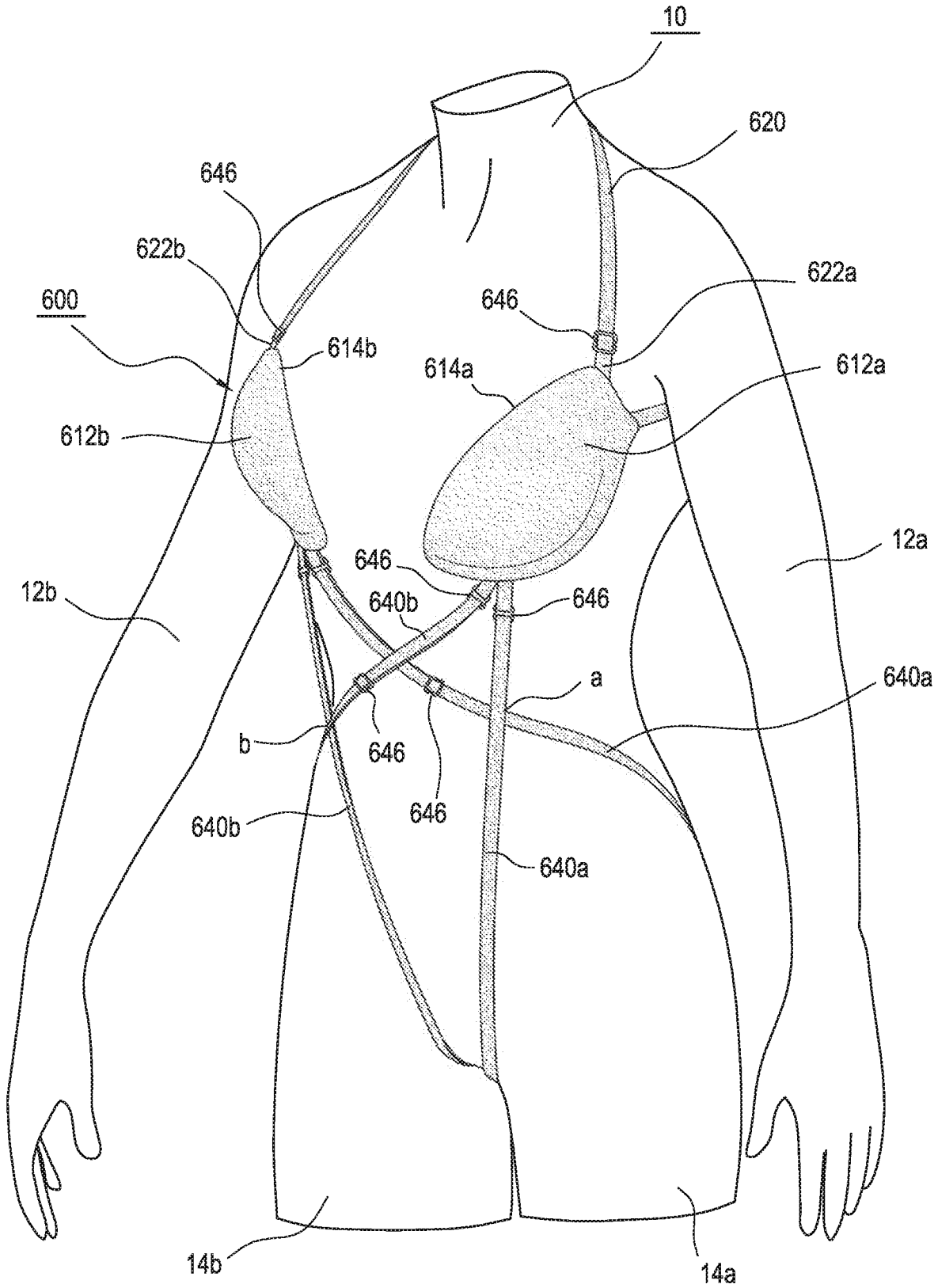
Figure 30:
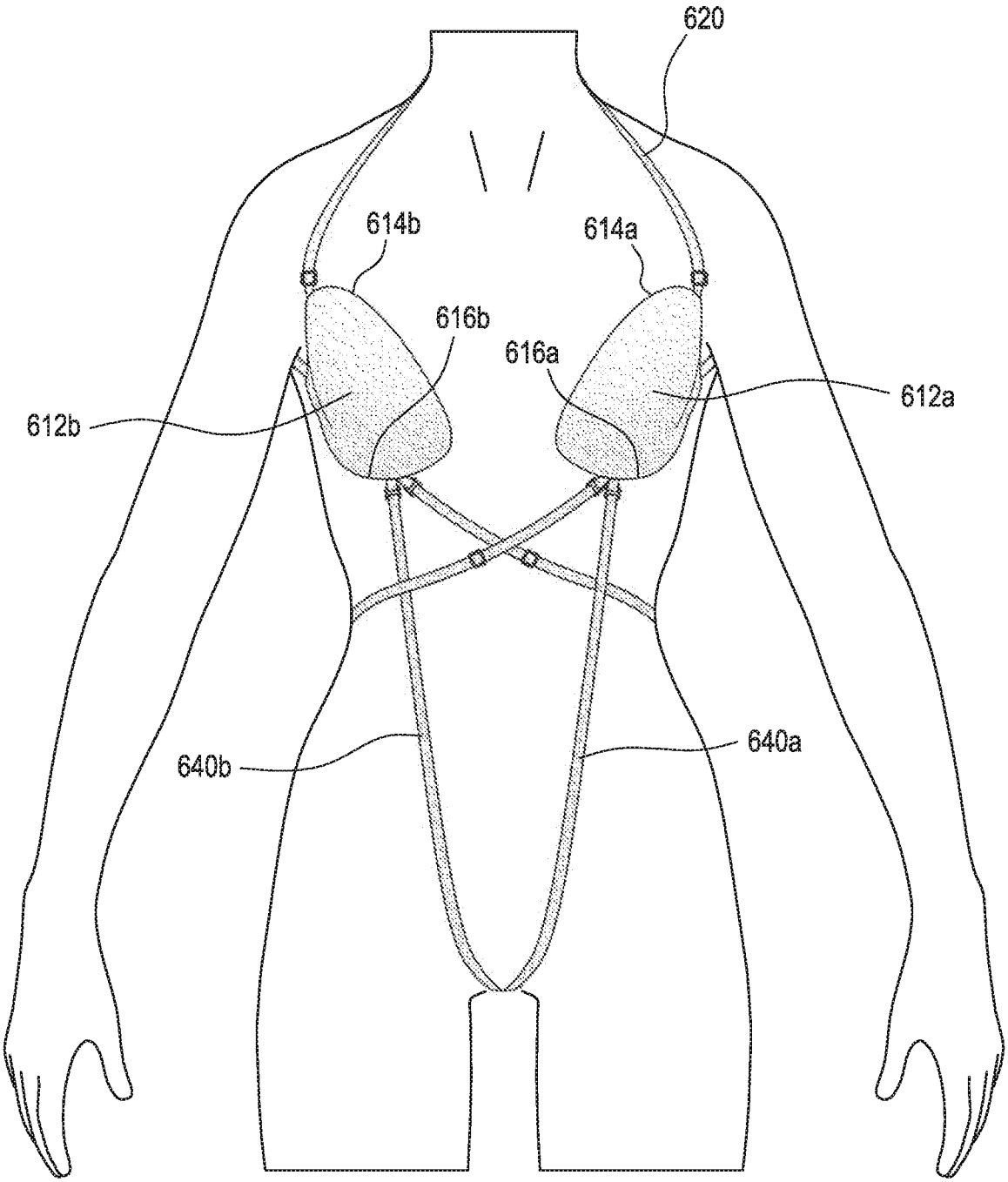

As shown in FIGS. 29 and 30, bra 600 includes left and right cups 612*a*, 612*b* and a pair of lower straps 640*a*, 640*b*. The left cup includes an upper edge 614*a* and a lower edge 616*a*. The right cup 612*b* includes an upper edge 614*b* and a lower edge 616*b*. The structure and function of left and right cups 612*a*, 612*b*, and lower straps 640*a*, 640*b* are the same as the corresponding components of bra 500 of the fifth embodiment. Therefore, details of these elements/structures and their respective functions (and variations) are not repeated herein.

Bra 600 includes a single neck halter 620 that is connected at its two ends to the left and right cups 612*a*, 612*b* at their respective upper edges 614*a*, 614*b*. Specifically, as shown in FIG. 29, a first end 622*a* of neck halter 620 is attached to left cup 612*a*, and a second end 622*b* of neck halter 620 is attached to right cup 612*b*. When bra 600 is worn, neck halter 620 extends around the wearer's neck. As with the other embodiments, the neck halter 620 as well as the lower straps 640*a*, 640*b* include sliders 646 to enable the wearer to adjust the length of the various straps. Fewer (including none) or more sliders can be provided, as desired.

Other features and variations previously described with respect other embodiments described herein are applicable to bra 600 of this sixth embodiment. For instance, the neck halter and/or the lower straps can be permanently affixed or attached to the respective cups, or, in variations, one or more of such straps can be detachable. With specific regard to neck halter 620, the neck halter can be disconnected (e.g., un-tied) behind the wearer's neck. It can be untied or otherwise disconnected in any manner known in the art. In other versions, it can be disconnected from one or both of the bra's cups in manners already described. In yet another version, the neck halter is permanently affixed to the cups. Other variations described herein, particularly with respect to bra 500 of the fifth embodiment, as well as the other embodiments, also are applicable to this embodiment.

Figure 31:
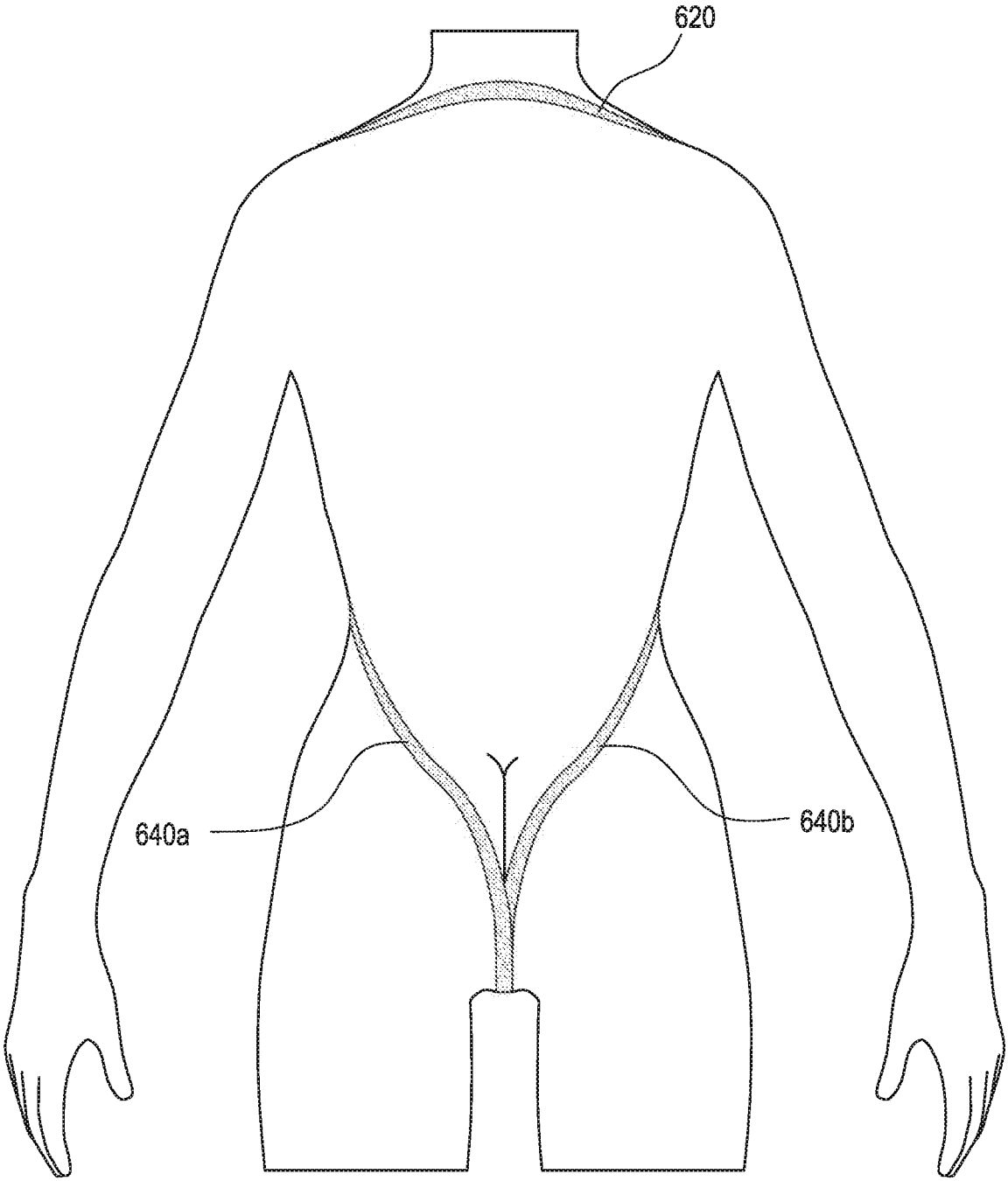
Figure 32:
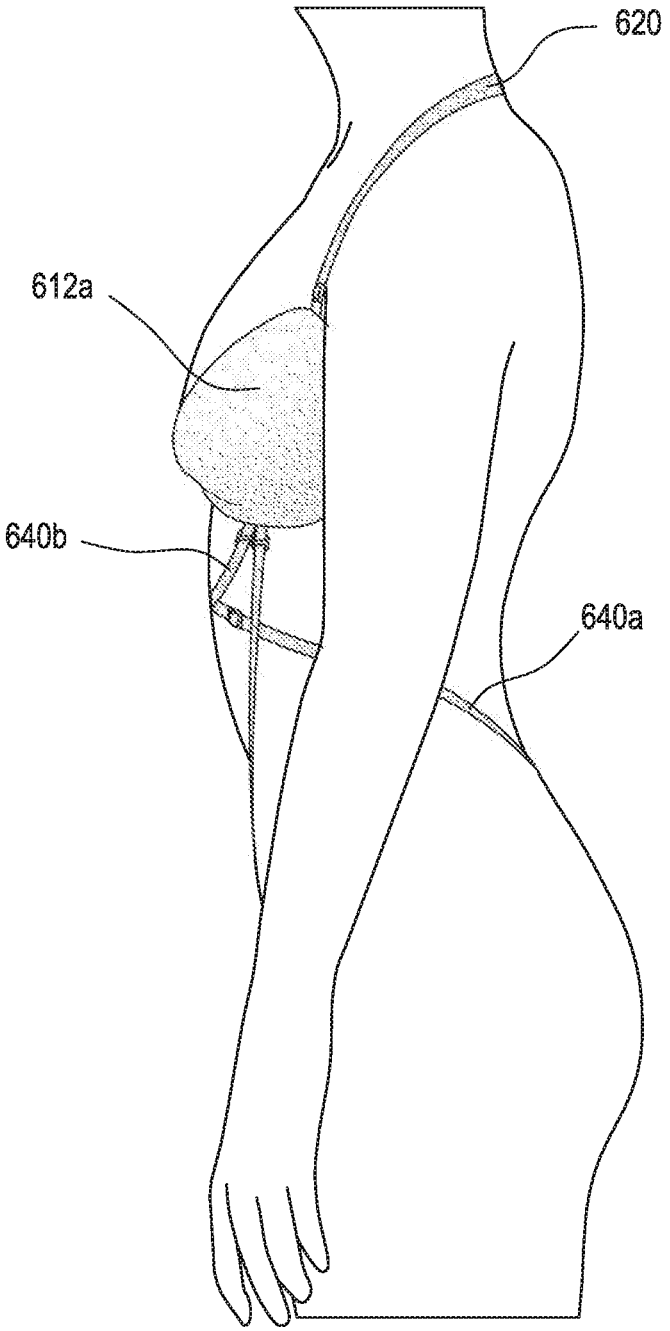
Figure 33:
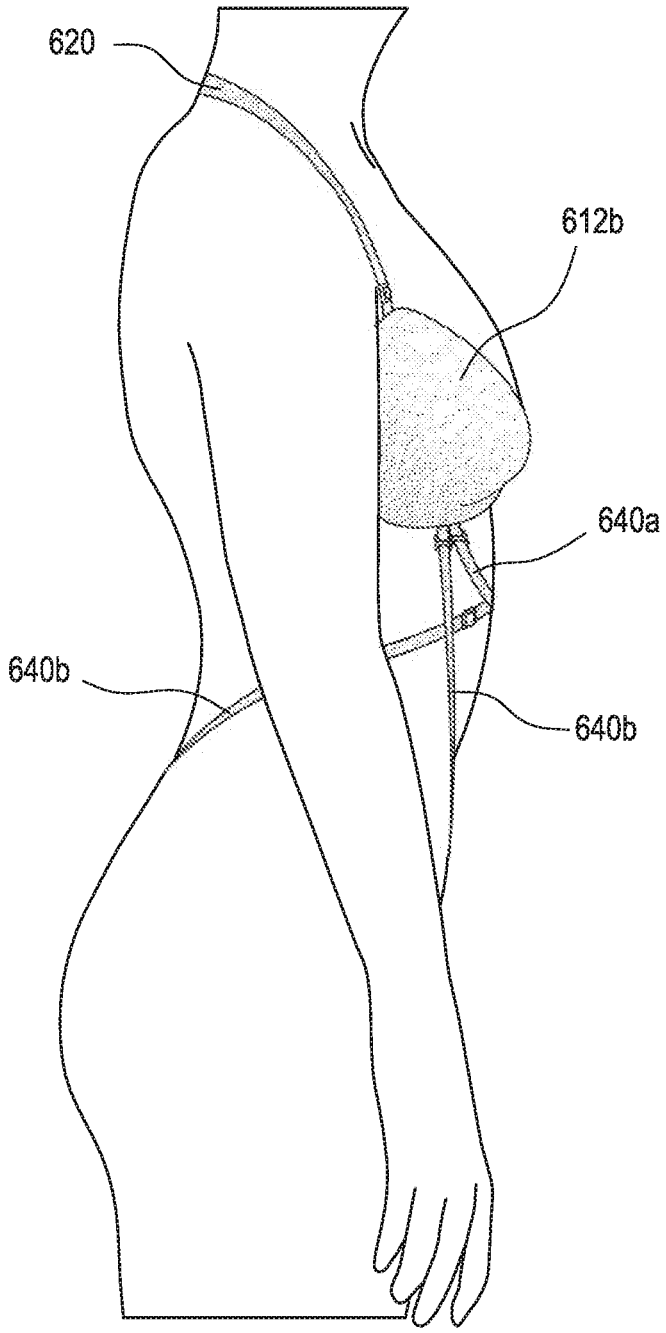
Figure 34:
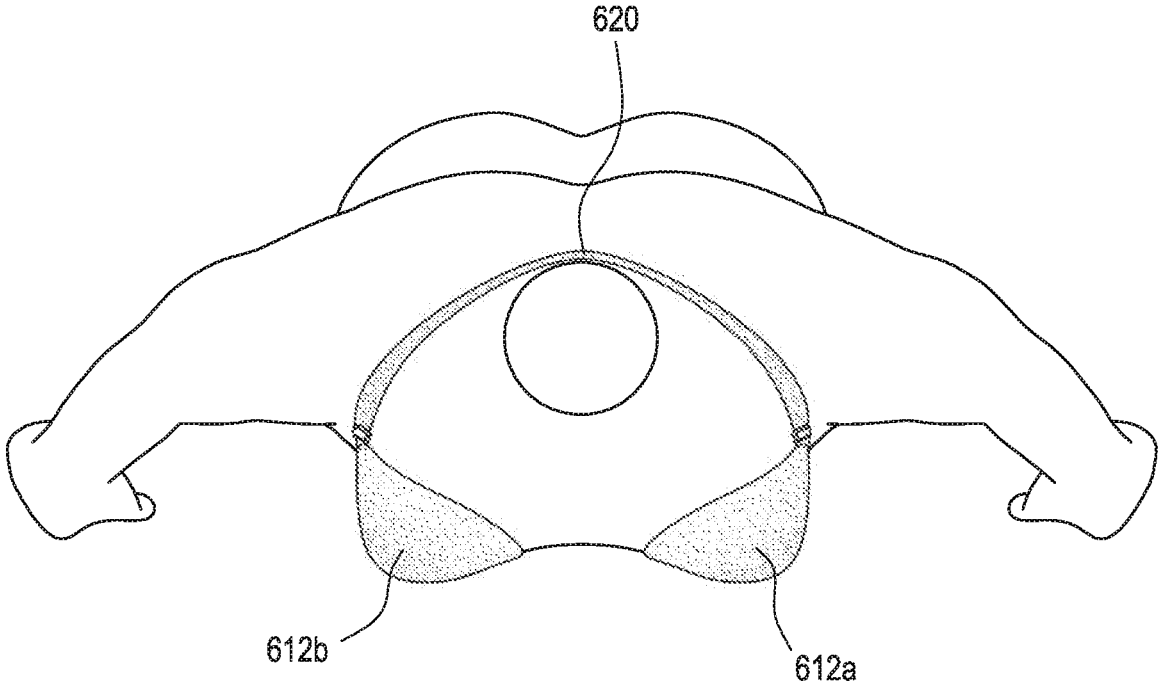
Figure 35:
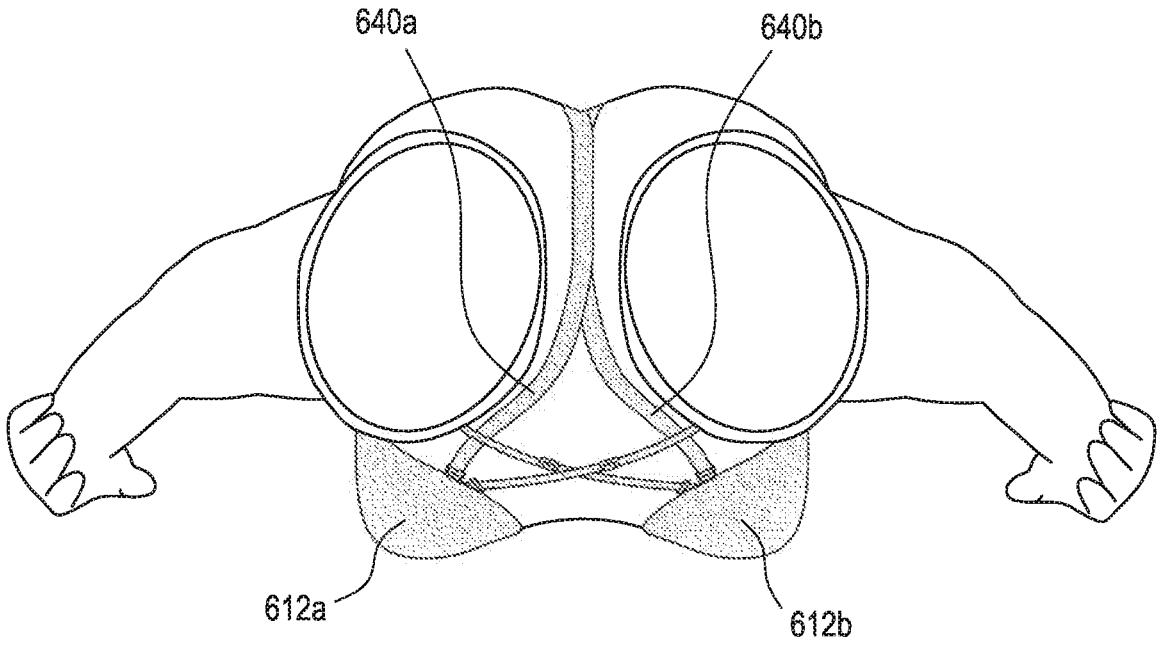
Figure 36:
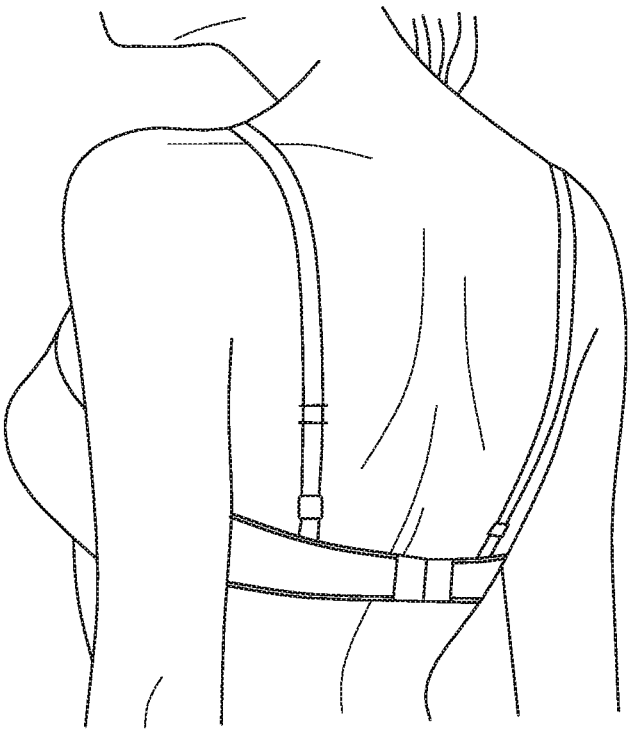
FIG. 36 PRIOR ART
FIG. 36 is a schematic illustration of a traditional, prior art bra.
Figure 37:
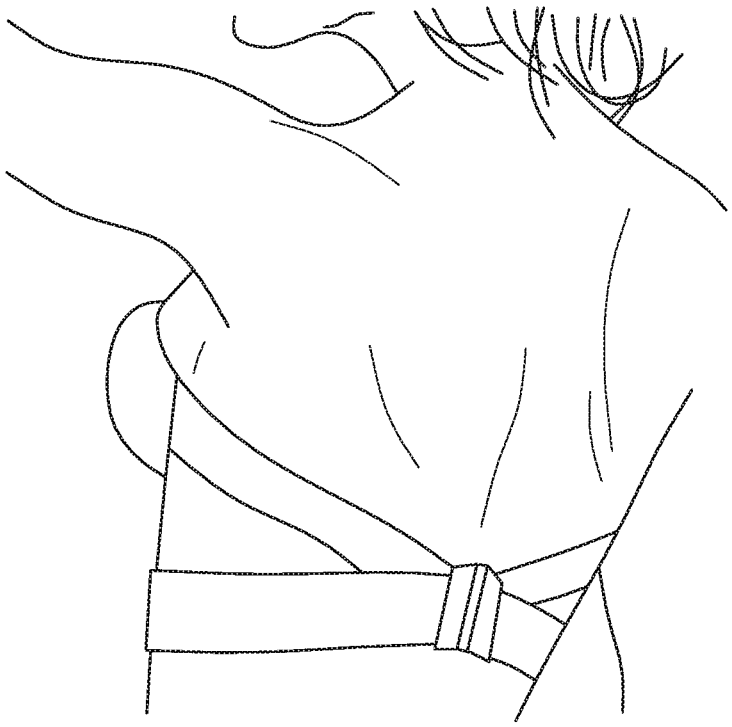
FIG. 37 PRIOR ART
FIG. 37 is a schematic illustration of another prior art bra.
Figure 38:
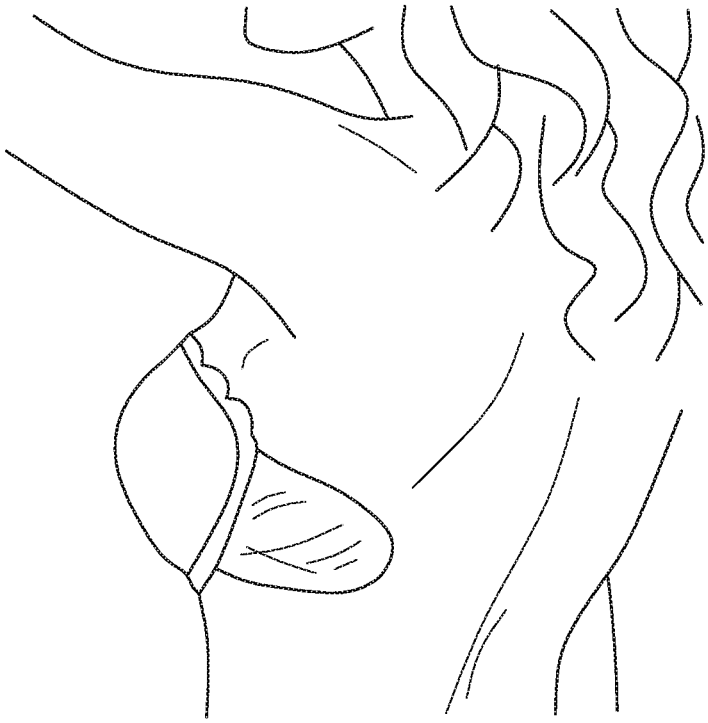
FIG. 38 PRIOR ART
FIG. 38 is a schematic illustration of a further prior art backless bra.

Like bra 500 of the fifth embodiment, bra 600 provides an unobstructed view of both the wearer's center chest area and the wearer's back, as shown in FIGS. 30 and 31, respectively. Moreover, neck halter 620 provides sufficient strength to support breast weight and flexibility to accommodate the wearer's movement.

Several embodiments of the present invention have been described. The present invention further includes methods of securing any of the disclosed versions of the bra of the present invention onto a wearer of the bra.

Various method can be adopted for the wearer to put on and take off each of the bras. For example, the wearer can "step" into the leg loops formed by the lower straps (the lower straps can be permanently or detachably affixed), and then raise the upper shoulder straps or the neck halter until they are disposed over the wearer's shoulders or neck.

In another method, to put on a bra of the present invention having lower straps including at least one of the first and second ends detachably attached, the wearer can put on the upper shoulder straps or the neck halter on the wearer's body first. After the upper strap(s) is disposed, the wearer extends the first lower strap of the bra through the pelvic region of the wearer and to extend around one leg of the wearer, and extend the second lower strap through the pelvic region of the wearer and to extend around the other leg of the wearer, and then use the connectors located at the one or more first and second ends (for example, the conventional hook and loop connectors) to attach the one or more first and second ends of the lower straps at various locations along the lower edges of the two cups.

After the upper straps and lower straps are disposed, the wearer can adjust the length of the various straps via the sliders, until the two cups are appropriately positioned.

It is appreciated that each version of the bras of the present invention may have multiple ways to be put on and taken off. It is to be understood that other methods that are applicable to each version of the bras of the present invention can be employed as would be appreciated to those of ordinary skill in the art. Therefore, it is to be understood that other methods may be employed but that stay within the meaning, scope and spirit of the invention.

With respect to each of the embodiments described herein, a number of functions and benefits have been discussed. Moreover, multiple variations have been discussed with respect to each of the embodiments described herein. It is appreciated that all or most of the variations discussed with respect to one embodiment are applicable to the other embodiments. Several examples are as follows.

Sliders are shown and/or described herein to enable the wearer to adjust the length of a particular strap. This is applicable to every embodiment. The number of sliders may be different from that mentioned. Thus, each strap may include zero, one, two or more such length adjustment mechanisms. Other length adjustment mechanisms may be employed, as would be readily understood in the art.

The various straps in each embodiment may be permanently affixed to a cup or other component, or in other variations, may be attachable/detachable to/from a respective component. Attachment mechanisms, such as hook and loop type connectors, buttons, hooks, snaps, zippers, buckles, frog fasteners, toggle fasteners, other techniques mentioned herein and other suitable types of connection techniques may be employed. In versions described herein in which a strap or other component is permanently affixed to another component, such as a cup, the manner of permanently affixing may be any suitable manner known in the art, including stitching together, gluing, or other permanent affixing technique.

The various components of each of the embodiments described herein, including the straps, cups and other elements may have different dimensions and/or shapes than that shown in the figures. For example, the straps described herein may be narrower or wider, be linear, curved, nonlinear, wavy, or be another shape, as well as thickness. The different components described herein may be manufactured from any number of materials, including those mentioned herein as well as suitable materials not mentioned herein. The elasticity, if any, and other characteristics of the materials employed may vary, as would be appreciated by those of ordinary skill in the art. The present invention in its various embodiments is not limited to any particular color (or lack thereof).

The cups of each of the embodiments described may have different shapes than that shown in the figures. For instance, the cups may be full-coverage type cups or partial coverage type cups. The cups may be round in shape or have other shapes, such as triangular, have a fanciful design, or other common or uncommon shape. The cups may be solid, such as shown in the figures, or partially solid. Hence, the term "cup" as used herein means a structure to support, either fully or partially, a breast for one or more purposes typical of a bra, including but not limited to providing weight distribution of a breast for comfort, health, or other purpose, to improve the appearance of clothes that are worn over the bra, or other purpose.

Certain embodiments described herein incorporate a panty into the bra. A panty, whether a thong-style or full-coverage type may be incorporated into any of the embodiments and variations thereof described herein. The panty may be a combination of the thong-style/full-coverage type or may be a panty type not already described herein. The panty, in certain versions, is affixed to the other components (e.g., lower straps) of the bra. In yet other versions, the panty is removably attachable to the other components of the bra. The particular size, shape and other characteristics of each panty component may vary, as would be appreciated by those of ordinary skill in the art. The amount of front and/or rear coverage of each panty component may be modified, as desired.

Bra 600 of the sixth embodiment includes a neck halter, rather than two shoulder straps. Accordingly, each of the other embodiments described herein may employ a single neck halter rather than shoulder straps. In such variations, the neck halter can be detachable or permanently affixed to the cups and/or main panels of the various embodiments and have other features and variations as described herein.

Certain terms are used herein for ease of reference and explanation. However, the labels used to refer to the various elements and components of the inventive backless bra may be modified as would be appreciated by those of ordinary skill in the art. For instance, rather than left and rights cup, left and right lower straps, and the like, the terms first and second cups, first and second lower straps, etc., may be suitably employed. Other suitable terminology still may be utilized within the meaning, scope and spirit of the invention.

Other variations described above are applicable to each and every embodiment described. In view of the foregoing, it is appreciated that while the present invention has been described with reference to specific schematic illustrations and descriptions, including variations thereof, various other changes may be made without departing from the spirit and scope of the invention. Such other variations may be made as would be appreciated to those of ordinary skill in the art. Therefore, it is to be understood that other expedients/variations may be employed but that stay within the meaning, scope and spirit of the invention.

Having described the present invention including various features and variations thereof, it is intended that the appended claims be interpreted as including the embodiments described herein, the alternatives mentioned above, and all equivalents thereto.

Legend

Tables 1-6 below are provided to identify, in table form, the various elements and components in the figures of the present application. The details of each of the elements and components are as described herein.

Table 1 below sets forth the parts of the wearer schematically illustrated in each of the figures in each of the embodiments described herein.

TABLE 1

| Ref | Name | Ref. | Name |
|---|---|---|---|
| 10 | wearer's body | 16 | back |
| 12a | left arm | 12b | right arm |
| 14a | left leg | 14b | right leg |

Table 2 below sets forth the parts of the backless support bra in accordance with the first embodiment shown in FIGS. 1-7.

TABLE 2

| Ref. | Name | Ref. | Name |
|---|---|---|---|
| 100 | bra | 110 | front main panel |
| 112a | left cup | 112b | right cup |
| 114a | upper edge of left cup | 114b | upper edge of right cup |
| 116a | lower edge of left cup | 116b | lower edge of right cup |
| 120a | left shoulder strap | 120b | right shoulder strap |
| 122a | first end of left shoulder strap | 122b | first end of right shoulder strap |
| 124a | second end of left shoulder strap | 124b | second end of right shoulder strap |
| 140a | left lower strap | 140b | right lower strap |
| 142a | first end of left lower strap | 142b | first end of right lower strap |
| 144a | second end of left lower strap | 144b | second end of right lower strap |
| 146 | slider | | |

Table 3 below sets forth the parts of the backless support bra in accordance with the second embodiment shown in FIGS. 8 and 9.

Table 3

| Ref. | Name | Ref. | Name |
|---|---|---|---|
| 200 | bra | 210 | front main panel |
| 212a | left cup | 212b | right cup |
| 214a | upper edge of left cup | 214b | upper edge of right cup |
| 216a | lower edge of left cup | 216b | lower edge of right cup |
| 220a | left shoulder strap | 220b | right shoulder strap |
| 222a | first end of left shoulder strap | 222b | first end of right shoulder strap |
| 224a | second end of left shoulder | 224b | second end of right shoulder strap |
| 240a | left lower strap | 240b | right lower strap |
| 242a | first end of left lower strap | 242b | first end of right lower strap |
| 244a | second end of left lower strap | 244b | second end of right lower strap |
| 246 | slider | | |

Table 4 below sets forth the parts of the backless support bra in accordance with the third embodiment shown in FIGS. 10-14.

TABLE 4

| Ref. | Name | Ref. | Name |
|---|---|---|---|
| 300 | bra | 310 | front main panel |
| 312a | left cup | 312b | right cup |
| 314a | upper edge of left cup | 314b | upper edge of right cup |
| 316a | lower edge of left cup | 316b | lower edge of right cup |
| 320a | left shoulder strap | 320b | right shoulder strap |

TABLE 4-continued

| Ref. | Name | Ref. | Name |
|---|---|---|---|
| 322a | first end of left shoulder strap | 322b | first end of right shoulder strap |
| 324a | second end of left shoulder strap | 324b | second end of right shoulder strap |
| 340a | left lower strap | 340b | right lower strap |
| 342a | first end of left lower strap | 342b | first end of right lower strap |
| 344a | second end of left lower strap | 344b | second end of right lower strap |
| 360A | front panty panel | 360B | rear panty panel |
| 346 | slider | 360 | panty |

Table 5 below sets forth the parts of the backless support bra in accordance with the fourth embodiment shown in FIGS. 15-21.

TABLE 5

| Ref. | Name | Ref. | Name |
|---|---|---|---|
| 400 | bra | 410 | front main panel |
| 412a | left cup | 412b | right cup |
| 414a | upper edge of left cup | 414b | upper edge of right cup |
| 416a | lower edge of left cup | 416b | lower edge of tight cup |
| 420a | left shoulder strap | 420b | right shoulder strap |
| 440a | left lower strap | 440b | right lower strap |
| 460A | front panty panel | 460B | rear panty panel |
| 446 | slider | 460 | panty |

Table 6 below sets forth the parts of the backless support bra in accordance with the fifth embodiment shown in FIGS. 22-28.

TABLE 6

| Ref | Name | Ref. | Name |
|---|---|---|---|
| 500 | bra | 546 | slider |
| 512 | left cup | 512b | right cup |
| 514 | upper edge of left cup | 514b | upper edge of right cup |
| 516 | lower edge of left cup | 516b | lower edge of right cup |
| 520 | left shoulder strap | 520b | right shoulder strap |
| 522 | first end of left shoulder strap | 522b | first end of right shoulder strap |
| 524 | second end of left shoulder strap | 524b | second end of right shoulder strap |
| 540 | left lower strap | 540b | right lower strap |
| 542 | first end of left lower strap | 542b | first end of right lower strap |
| 544 | second end of left lower strap | 544b | second end of right lower strap |

Table 7 below sets forth the parts of the backless support bra in accordance with the sixth embodiment shown in FIGS. 29-35.

TABLE 7

| Ref. | Name | Ref. | Name |
|---|---|---|---|
| 600 | bra | 646 | slider |
| 612a | left cup | 612b | right cup |
| 614a | upper edge of left cup | 614b | upper edge of right cup |
| 616a | lower edge of left cup | 616b | lower edge of right cup |
| 620 | neck halter | 622b | second end of neck halter |
| 622a | first end of neck halter | 640b | right lower strap |
| 640a | left lower strap | | |

What is claimed is:

1. A backless support bra, comprising:

first and second cups, the first and second cups not in direct attachment to one another, each of the first and second cups configured to support a respective breast of a wearer when the backless support bra is worn by the wearer;

at least one upper strap having first and second ends for upwardly supporting the first and second cups;

first and second lower straps, each of the first and second lower straps having first and second ends for downwardly supporting the first and second cups, the first lower strap configured to extend through a pelvic region of the wearer and to extend around one leg of the wearer, the second lower strap configured to extend through the pelvic region of the wearer and to extend around the other leg of the wearer;

wherein the first end of the first lower strap is attached to the first cup, and the second end of the first lower strap is attached to the second cup; and wherein the first end of the second lower strap is attached to the second cup, and the second end of the second lower strap is attached to the first cup.

2. The backless support bra of claim 1, wherein, when the backless support bra is worn by the wearer, substantially all of the first and second lower straps are disposed along a front portion of the wearer so that substantially all of the wearer's back is unobstructed by the first and second lower straps and said at least one upper strap.

3. The backless support bra of claim 1, wherein the at least one upper strap and the first and second lower straps are permanently affixed to at least one of the first and second cups.

4. The backless support bra of claim 1, wherein at least one of the first and second lower straps are removably connected to at least one of the first and second cups.

5. The backless support bra of claim 1, wherein said at least one upper strap is comprised of first and second upper straps, the first upper strap including first and second ends both attached to the first cup, the second upper strap including first and second ends both attached to the second cup.

6. The backless support bra of claim 5, wherein each of the first and second upper straps is configured to be worn around a respective shoulder of the wearer of the backless support bra.

7. A backless support bra, comprising:

first and second cups, the first and second cups not in direct attachment to one another, each of the first and second cups configured to support a respective breast of a wearer when the backless support bra is worn by the wearer;

at least one upper strap having first and second ends configured to upwardly support the first and second cups when worn; and first and second lower straps configured to downwardly support the first and second cups when worn, the first and second lower straps configured to extend downward from respective ones of the first and second cups to a pelvic region of the wearer, extend through a buttocks of the wearer, and extend around respective legs of the wearer;

wherein a first end of the first lower strap is attached to the first cup and a second end of the first lower strap is attached to the second cup; and wherein a first end of the second lower strap is attached to the second cup and a second end of the second lower strap is attached to the first cup.

8. A backless support bra, comprising:

first and second cups, the first and second cups not in direct attachment to one another, each of the first and second cups configured to support a respective breast of a wearer when the backless support bra is worn by the wearer;

at least one upper strap having first and second ends configured to upwardly support the first and second cups when worn; and first and second lower straps configured to downwardly support the first and second cups when worn, the first and second lower straps configured to extend downward from respective ones of the first and second cups to a pelvic region of the wearer, extend through a buttocks of the wearer, and extend around respective legs of the wearer;

wherein said at least one upper strap is comprised of first and second upper straps, the first upper strap including first and second ends both attached to the first cup and configured to be worn around a first shoulder of the wearer, the second upper strap including first and second ends both attached to the second cup and configured to be worn around a second shoulder of the wearer.

* * * * *